US006472813B2

(12) United States Patent
Mitsutake et al.

(10) Patent No.: US 6,472,813 B2
(45) **Date of Patent: *Oct. 29, 2002**

(54) IMAGE FORMING APPARATUS FOR FORMING IMAGE BY ELECTRON IRRADIATION FROM ELECTRON-EMITTING DEVICE

(75) Inventors: Hideaki Mitsutake, Yokohama; Hidetoshi Suzuki, Fujisawa; Naoto Nakamura, Isehara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/047,224

(22) Filed: Mar. 25, 1998

(65) Prior Publication Data

US 2002/0109455 A1 Aug. 15, 2002

(51) Int. Cl.[7] ..... H01J 1/62

(52) U.S. Cl. ..... 313/495; 313/306; 313/336; 313/351; 313/497; 313/422; 313/292

(58) Field of Search ..... 313/307, 309, 313/310, 336, 351, 495–497, 292, 422, 306, 308, 238, 268, 281, 283, 253, 256, 258; 315/169.1, 169.4, 169.3

(56) References Cited

U.S. PATENT DOCUMENTS

| | | | | |
|---|---|---|---|---|
| 4,904,895 A | | 2/1990 | Tsukamoto et al. | 313/336 |
| 5,066,883 A | | 11/1991 | Yoshioka et al. | 313/309 |
| 5,614,781 A | * | 3/1997 | Spindt et al. | 313/495 X |
| 5,619,097 A | | 4/1997 | Jones | 313/495 |
| 5,734,883 A | | 3/1998 | Tagawa et al. | 313/493 |
| 5,838,097 A | * | 11/1998 | Kasanuki et al. | 313/495 |
| 5,994,832 A | | 11/1999 | Yura et al. | 313/495 |
| 6,144,154 A | | 11/2000 | Yamazaki et al. | 313/495 |

FOREIGN PATENT DOCUMENTS

| | | |
|---|---|---|
| JP | 63-274047 A | 11/1988 |
| JP | 64-31332 A | 2/1989 |
| JP | 2-257551 A | 10/1990 |
| JP | 3-55738 A | 3/1991 |
| JP | 4-28137 A | 1/1992 |
| JP | 8-7809 | 1/1996 |

OTHER PUBLICATIONS

H. Araki, et al., Electroforming and Electron Emission of Carbon Thin Films, Journal of the Vacuum Society of Japan, vol. 26, No. 1, pp. 22–29, (Sep. 1983).

M. Hartwell, et al., Strong Electron Emission from Patterned Tin–Idium Oxide Thin Films, International Electron Devices Meeting, pp. 519–521, (1975).

(List continued on next page.)

*Primary Examiner*—Michael H. Day
*Assistant Examiner*—Mack Haynes
(74) *Attorney, Agent, or Firm*—Fitzpatrick, Cella, Harper & Scinto

(57) ABSTRACT

This invention discloses an image forming apparatus having an electron source on which a plurality of electron-emitting devices are arranged, an image forming member on which an image is formed by electrons emitted by the electron-emitting devices, and a structure for maintaining an interval between the electron source and the image forming member, in which an interval between two electron-emitting devices adjacent to each other via the structure is larger than an interval between two electron-emitting devices adjacent to each other without the mediacy of the structure, and electrons emitted by the electron-emitting devices are deflected toward the structure.

21 Claims, 29 Drawing Sheets

OTHER PUBLICATIONS

G. Dittmer, Electrical Conduction and Electron Emission of Discontinuous Thin Films, Thin Solid Films, vol. 9, pp. 317–328, 1972.

M. I. Elinson, et al., The Emission of Hot Electrons and the Field Emission of Electrons from Tin Oxide, Radio Engineering and Electronic Physics, pp. 1290–1296, (Jul. 1965).

C.A. Mead, et al., Operation of Tunnel–Emission Devices, Journal of Applied Physics, vol. 32, No. 4, pp. 646–652, (Apr. 1961).

W.P. Dyke, et al., Field Emission, Advances in Electronics and Electron Physics, pp. 89–185 (1956).

R. Meyer, Recent Development on Microtips Display at LETI, Tech. Digest of 4th Int. Vacuum Microelectronics Conf., Nagahama, pp. 6–9 (1991).

C.A. Spindt, et al., Physical Properties of Thin–Film Field Emission Cathodes with Molybdenum Cones, Journal of Applied Physics, vol . 47, No. 12, pp. 5248–5263, (Dec. 1976).

* cited by examiner

PRIOR ART FIG. 27
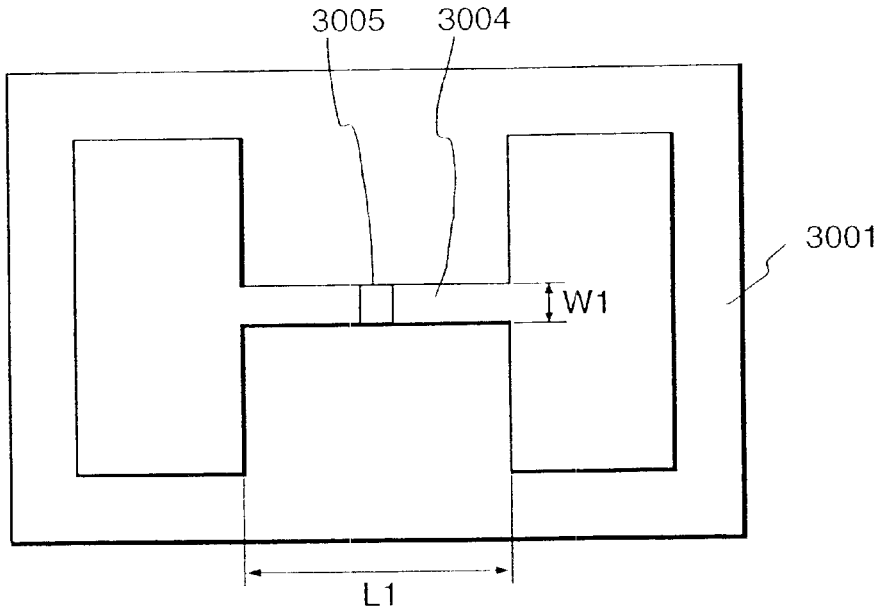
PRIOR ART FIG. 28
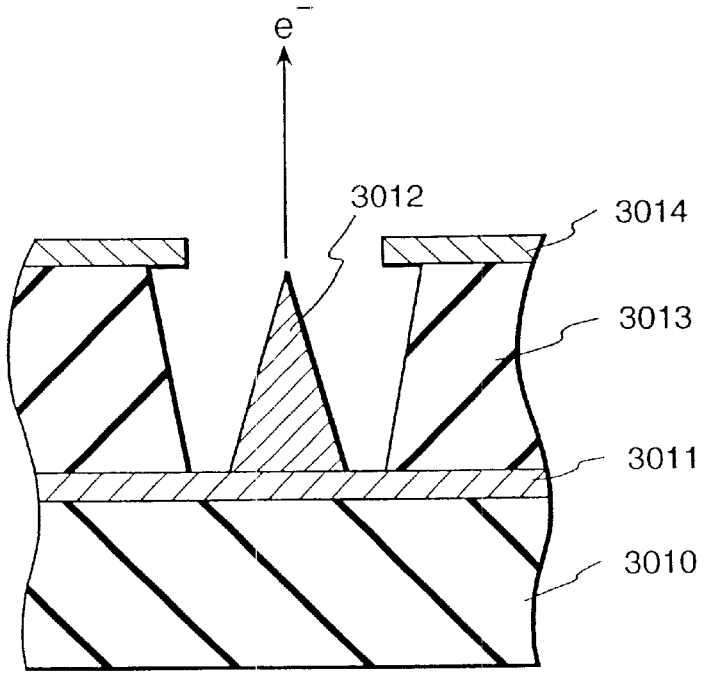

IMAGE FORMING APPARATUS FOR FORMING IMAGE BY ELECTRON IRRADIATION FROM ELECTRON-EMITTING DEVICE

BACKGROUND OF THE INVENTION

1. Field of the Invention

The present invention relates to an image forming apparatus and, more particularly, to an image forming apparatus for forming an image by irradiating electrons emitted by an electron-emitting device on an image forming member.

2. Description of the Related Art

Conventionally, two types of devices, namely hot and cold cathode devices, are known as electron-emitting devices. Known examples of the cold cathode devices are surface-conduction emission (SCE) type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction emission type electron-emitting devices is described in, e.g., M. I. Elinson, "Radio Eng. Electron Phys., 10, 1290 (1965) and other examples will be described later.

The surface-conduction emission type electron-emitting device utilizes the phenomenon that electrons are emitted from a small-area thin film formed on a substrate by flowing a current parallel through the film surface. The surface-conduction emission type electron-emitting device includes electron-emitting devices using an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 27 is a plan view showing the device by M. Hartwell et al. described above as a typical example of the device structures of these surface-conduction emission type electron-emitting devices. Referring to FIG. 27, numeral 3001 denotes a substrate; and 3004, a conductive thin film made of a metal oxide formed by sputtering. This conductive thin film 3004 has an H-shaped pattern, as shown in FIG. 27. An electron-emitting portion 3005 is formed by performing electrification processing (referred to as forming processing to be described later) with respect to the conductive thin film 3004. An interval L in FIG. 27 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion.

In the above surface-conduction emission type electron-emitting devices by M. Hartwell et al. and the like, typically the electron-emitting portion 3005 is formed by performing electrification processing called energization forming processing for the conductive thin film 3004 before electron emission. The forming processing is to form an electron-emitting portion by electrification. For example, a constant DC voltage or a DC voltage which increases at a very low rate of, e.g., 1 V/min is applied across the two ends of the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after the forming processing, electrons are emitted near the fissure.

Known examples of the FE type electron-emitting devices are described in W. P. Dykeand W. W. Dolan, "Field emission", Advances in Electronics and Electron Physics, 8, 89 (1956) and C. A. Spindt, "Physical properties of thin-film field emission cathodes with molybdenum cones", J. Appl. Phys., 47, 5248 (1976).

FIG. 28 is a cross-sectional view showing the device by C. A. Spindt et al. described above as a typical example of the FE type device structure. Referring to FIG. 28, numeral 3010 denotes a substrate; 3011, emitter wiring made of a conductive material; 3012, an emitter cone; 3013, an insulating layer; and 3014, a gate electrode. In this device, a voltage is applied between the emitter cone 3012 and the gate electrode 3014 to emit electrons from the distal end portion of the emitter cone 3012.

As another FE type device structure, there is an example in which an emitter and a gate electrode are arranged on a substrate to be almost parallel to the surface of the substrate, in addition to the multilayered structure of FIG. 28.

A known example of the MIM type electron-emitting devices is described in C. A. Mead, "Operation of Tunnel-Emission Devices", J. Appl. Phys., 32, 646 (1961). FIG. 29 shows a typical example of the MIM type device structure. FIG. 29 is a cross-sectional view of the MIM type electron-emitting device. Referring to FIG. 29, numeral 3020 denotes a substrate; 3021, a lower electrode made of a metal; 3022, a thin insulating layer having a thickness of about 100 Å; and 3023, an upper electrode made of a metal and having a thickness of about 80 to 300 Å. In the MIM type electron-emitting device, an appropriate voltage is applied between the upper electrode 3023 and the lower electrode 3021 to emit electrons from the surface of the upper electrode 3023.

Since the above-described cold cathode devices can emit electrons at a temperature lower than that for hot cathode devices, they do not require any heater. The cold cathode device therefore has a structure simpler than that of the hot cathode device and can be micro patterned. Even if a large number of devices are arranged on a substrate at a high density, problems such as heat fusion of the substrate hardly arise. In addition, the response speed of the cold cathode device is high, while the response speed of the hot cathode device is low because it operates upon heating by a heater.

For this reason, applications of the cold cathode devices have enthusiastically been studied.

Of cold cathode devices, the above surface-conduction emission type electron-emitting devices are advantageous because they have a simple structure and can be easily manufactured. For this reason, many devices can be formed on a wide area. As disclosed in Japanese Patent Laid-Open No. 64-31332 filed by the present applicant, a method of arranging and driving a lot of devices has been studied.

Regarding applications of surface-conduction emission type electron-emitting devices to, e.g., image forming apparatuses such as an image display apparatus and an image recording apparatus, electron-beam sources, and the like have been studied.

As an application to image display apparatuses, in particular, as disclosed in U.S. Pat. No. 5,066,883 and Japanese Patent Laid-Open Nos. 2-257551 and 4-28137 filed by the present applicant, a image display apparatus using the combination of an surface-conduction emission type electron-emitting device and a fluorescent substance which emits light upon reception of an electron beam has been studied. This type of image display apparatus using the combination of the surface-conduction emission type electron-emitting device and the fluorescent substance is expected to have more excellent characteristics than other conventional image display apparatuses. For example, in comparison with recent popular liquid crystal display apparatuses, the above display apparatus is superior in that it does not require a back light because it is of a self-emission type and in that it has a wide view angle.

A method of driving a plurality of FE type electron-emitting devices arranged side by side is disclosed in, e.g., U.S. Pat. No. 4,904,895 filed by the present applicant. As a known example of an application of FE type electron-emitting devices to an image display apparatus is a flat display apparatus reported by R. Meyer et al. [R. Meyer: "Recent Development on Microtips Display at LETI", Tech. Digest of 4th Int. Vacuum Microelectronics Conf., Nagahama, pp. 6–9 (1991)].

An example of an application of a larger number of MIM type electron-emitting devices arranged side by side to an image display apparatus is disclosed in Japanese Patent Laid-Open No. 3-55738 filed by the present applicant.

The present inventors have examined cold cathode devices of various materials, various manufacturing methods, and various structures, in addition to the above-mentioned conventional cold cathode devices. Further, the present inventors have made extensive studies on a multi electron-beam source having a large number of cold cathode devices, and an image display apparatus using this multi electron-beam source.

The present inventors have examined a multi electron-beam source having an electrical wiring method shown in, e.g., FIG. 30. That is, a large number of cold cathode devices are two-dimensionally arranged in a matrix to obtain a multi electron-beam source, as shown in FIG. 30.

Referring to FIG. 30, numeral 4001 denotes each cold cathode device; 4002, each row wiring; and 4003, each column wiring. The row and column wirings 4002 and 4003 actually have finite electrical resistances, which are represented as wiring resistances 4004 and 4005 in FIG. 30. This wiring method is called a simple matrix wiring method.

For illustrative convenience, the multi electron-beam source is illustrated in a 6×6 matrix, but the size of the matrix is not limited to this. For example, in a multi electron-beam source for an image display apparatus, a number of devices sufficient to perform a desired image display are arranged and wired.

In a multi electron-beam source in which cold cathode devices are arranged in a simple matrix, appropriate electrical signals are applied to the row and column wirings 4002 and 4003 to output a desired electron beam. For example, to drive the cold cathode devices of an arbitrary row in the matrix, a selection voltage Vs is applied to the column wiring 4002 of the row to be selected, and at the same time, a non-selection voltage Vns is applied to the row wirings 4002 of the unselected rows. In synchronism with this, a driving voltage Ve for outputting an electron beam is applied to the column wirings 4003. According to this method, when voltage drops across the wiring resistances 4004 and 4005 are neglected, a voltage (Ve−Vs) is applied to the cold cathode device of the selected row, while a voltage (Ve−Vns) is applied to the cold cathode devices of the unselected rows. When the voltages Ve, Vs, and Vns are set at appropriate magnitudes, an electron beam having a desired intensity must be output from the cold cathode device of the selected row. When different driving voltages Ve are applied to the respective column wirings, electron beams having different intensities must be output from the respective devices of the selected row. A change in length of time for which the driving voltage Ve is applied necessarily causes a change in length of time for which an electron beam is output.

A multi electron-beam source in which cold cathode devices are wired in a simple matrix has a variety of applications. For example, when an electrical signal corresponding to image information is appropriately applied, the multi electron-beam source can be suitably used as an electron source for an image display apparatus.

In an image forming apparatus using a flat envelope (airtight container) such as a thin image display apparatus, a spacer (support column) is frequently used as a structure resistant to the atmospheric pressure. Since this spacer increases the mechanical strength of the envelope, the envelope can be made thin. Particularly in a large-size apparatus, the spacer is effective for reducing the apparatus size, the apparatus weight, and the raw material cost.

Considering the purpose of the spacer, the spacer is often installed in a region where electron-emitting devices of a multi-beam electron source are arranged. In addition, the spacer requires a size (thickness, diameter, and the like) large enough to resist the atmospheric pressure, and a location for fixing the spacer.

To realize a high-resolution image forming apparatus, electron-emitting devices must be arranged for a multi-beam electron source at a high density. Depending on the spacer size and a necessary installation region size, electron-emitting devices may be difficult to arrange near the spacer at a high density.

FIGS. 31A and 31B are a cross-sectional view and a plan view, respectively, showing an example of an image display apparatus using a multi electron-beam source in order to explain the above problem in detail.

Referring to FIGS. 31A and 31B, many cold cathode devices 4102 are formed on a substrate 4101, and fluorescent substances 4108 are arranged on the inner surface of a face plate 4107 facing the substrate 4101. A plate-like spacer 4119 is arranged as a structure resistant to the atmospheric pressure between the substrate 4101 and the face plate 4107. This apparatus is a light-emitting type image display apparatus for emitting visible light by irradiating electron beams e emitted by the cold cathode devices 4102 on the fluorescent substances 4108.

To obtain a desired resolution of the image display apparatus, pixels must be arranged at, e.g., a pitch Px in the X direction. In this case, the fluorescent substances 4108 are arranged on the entire display screen of the face plate 4107 at the pitch Px, and the cold cathode devices 4102 are also arranged on the substrate 4101 at the same pitch Px.

FIG. 31B is a plan view of the substrate 4101 on which the cold cathode devices 4102 are arranged. The cold cathode devices 4102 may be difficult to form within the range (portion C surrounded by the dotted line in FIG. 31B) defined by a predetermined distance Ld from the installation location of the spacer 4119.

For example, an adhesive (e.g., frit glass) used to fix the spacer 4119 on the substrate 4101 is squeezed out to portions near cold cathode devices around the spacer, which may disturb the electric field near the electron-emitting portion of the cold cathode device and may change the orbit of an emitted electron. This is because an electron is easily influenced by the disturbance of the electric field near the substrate 4101 owing to a low speed of the electron immediately after emission. To the contrary, on the face plate 4107 side, even if an adhesive used to fix the spacer 4119 on the face plate 4107 is squeezed out to portions near the fluorescent substances 4108, the electron orbit is hardly changed by the disturbance of the electric field near the face plate 4107 because an emitted electron near the face plate is accelerated to a great degree.

Wiring for driving the cold cathode devices 4102 is arranged on the substrate 4101 in addition to the cold cathode devices 4102. This decreases room for installing the spacer 4119.

Since the cold cathode devices 4102 are difficult to form around the spacer 4119, as described above, a light emission disabled region (region D surrounded by the dotted line in FIG. 31A) is generated in the display apparatus of FIG. 31A. In this region, even if fluorescent substances 4108 (in black in FIG. 31A) are arranged, no electron beam can be irradiated on these fluorescent substances 4108, so no image can be displayed. Accordingly, even if a large-screen image display apparatus is fabricated, a striped or matrix-like light emission disabled region is generated near the spacer position on the screen, resulting in very low image quality.

SUMMARY OF THE INVENTION

An image forming apparatus according to the present invention has the following structure.

There is provided an image forming apparatus comprising:

- an electron source on which a plurality of electron-emitting devices are arranged;
- an image forming member on which an image is formed by electrons emitted by the electron-emitting devices;
- a structure arranged between the electron source and the image forming member to maintain an interval between the electron source and the image forming member; and
- deflection means for deflecting electrons emitted by the electron-emitting devices toward the structure until the electrons reach the image forming member.

In the present invention, since electrons are deflected toward the structure, the image formation disabled area can be decreased.

More specifically, the plurality of electron-emitting devices can be arranged substantially linearly. If the electron-emitting devices are two-dimensionally arranged, a plurality of units of electron-emitting devices arranged substantially linearly may be used.

As the electron-emitting device, an electron-emitting device constituted by a negative electrode, an electron-emitting portion, and a positive electrode which are arranged on a substrate surface for arranging the electron-emitting devices can be used. In this structure, an electron emitted from an electron-emitting portion is deflected toward the positive electrode. Accordingly, by arranging the positive electrode nearer the structure than the negative electrode, the electron-emitting device can also serve as the deflection means. That is, the present invention is not limited to any structure in which special means for deflecting electrons must be arranged.

To deflect electrons by the electron-emitting device, a surface-conduction emission type electron-emitting device or a lateral field emission type electron-emitting device can be used.

As the deflection means, a deflection electrode arranged between the structure and a path through which electrons emitted by the electron-emitting devices reach irradiation positions of the image forming member can be adopted.

As the electron-emitting device used in the present invention, a field emission type electron-emitting device, a surface-conduction emission type electron-emitting device, or a MIM type electron-emitting device can be employed. Of these devices, the surface-conduction emission type electron-emitting device is particularly desirable.

The plurality of electron-emitting devices may be wired in a matrix by row-direction wiring and column-direction wiring.

When electrons emitted by the plurality of electron-emitting devices reach the image forming member to form pixels, an interval between pixels formed by electrons emitted by two electron-emitting devices adjacent to each other via the structure is preferably almost equal to an interval between pixels formed by electrons emitted by two electron-emitting devices adjacent to each other without mediacy of the structure.

The present specification also includes an image forming apparatus having the following structure.

There is provided an image forming apparatus comprising:

- an electron source having a plurality of electron-emitting devices arranged substantially linearly;
- an image forming member on which an image is formed by electrons emitted by the electron-emitting devices; and
- a structure arranged between the electron source and the image forming member to maintain an interval between the electron source and the image forming member,
- wherein an interval between two electron-emitting devices adjacent to each other via the structure is larger than an interval between two electron-emitting devices adjacent to each other without mediacy of the structure, and electrons emitted by the electron-emitting devices are deflected toward the structure until the electrons reach the image forming member.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 27 is a plan view of an example of the surface-conduction emission type electron-emitting device;

FIG. 28 is a cross-sectional view showing an example of the field emission type (FE type) electron-emitting device;

DETAILED DESCRIPTION OF THE PREFERRED EMBODIMENTS

The preferred embodiments of the present invention will be described in detail below with reference to the accompanying drawings.

Figure 1:
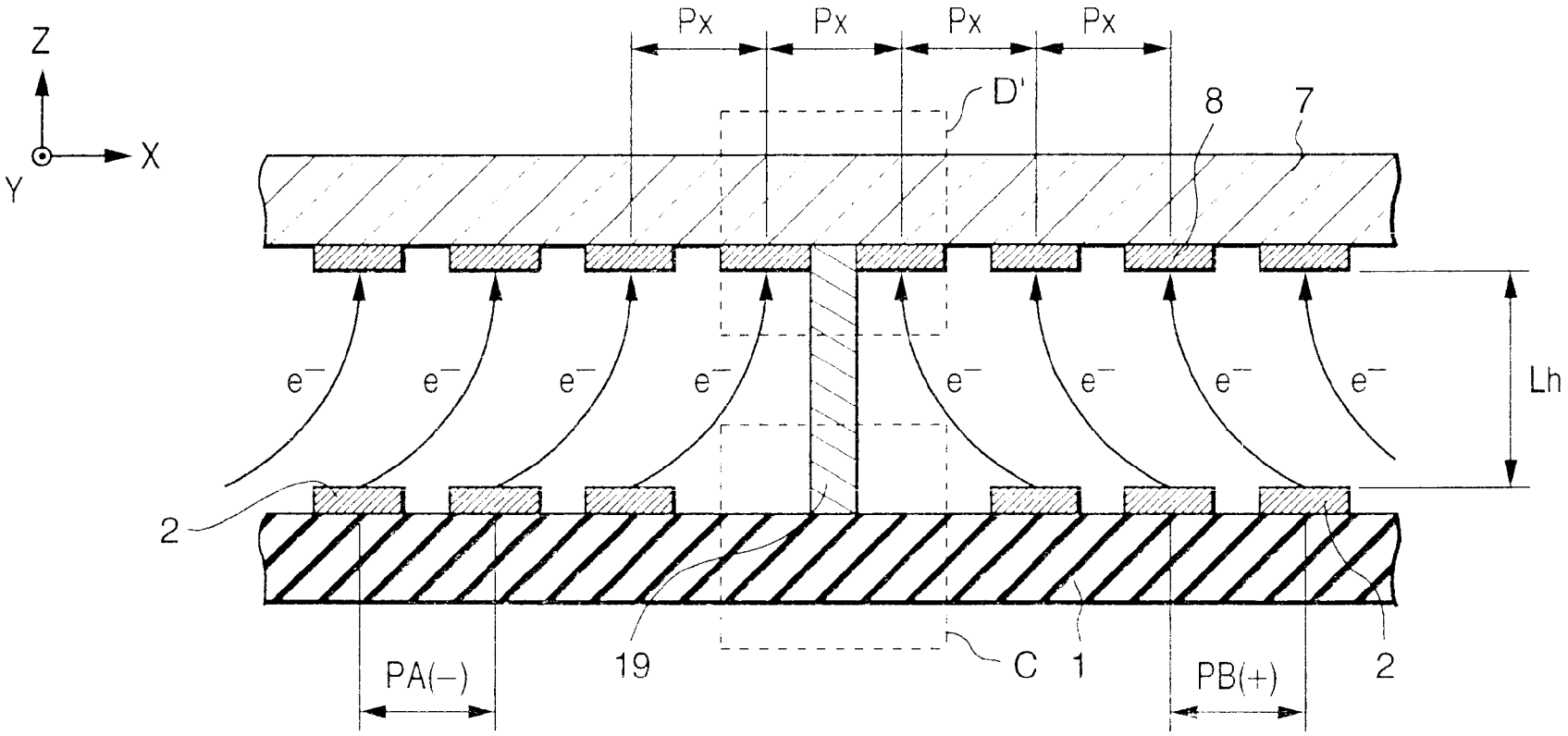
FIG. 1 is a cross-sectional view of the structure of an electron source in the present invention.

FIG. 1 is a cross-sectional view of an apparatus for explaining the principle of the present invention. Electron-emitting devices 2 are formed on a substrate 1. The structure and arrangement of the electron-emitting devices 2 formed on the substrate 1, and a method of applying a driving voltage to the electron-emitting devices 2 will be described later. Fluorescent substances 8 are arranged on the inner surface of a face plate 7 facing the substrate 1. A plate-like spacer 19 is arranged as a structure resistant to the atmospheric pressure between the substrate 1 and the face plate 7.

In the present invention, when an electron beam emitted by the electron-emitting device 2 travels to the face plate 7, it does not travel linearly in the Z direction in FIG. 1, but propagates toward the spacer 19 while propagating in the z direction, as shown in FIG. 1. That is, in the case of FIG. 1, an electron beam emitted by an electron-emitting device 2 (−) formed on the (−X) side of the spacer 19 propagates in the Z direction, and at the same time in the (+X) direction.

On the other hand, an electron beam emitted by an electron-emitting device 2 (+) formed on the (+X) side of the spacer 19 propagates in the Z direction, and also in the (−X) direction. For this reason, electrons can be irradiated on a region (portion D' surrounded by the dotted line in FIG. 1) on which no electron beam has not conventionally been irradiated. Letting Px be the alignment pitch between pixels in the X direction, an interval Px(−) between electron-emitting devices 2(−) on the (−X) side of the spacer 19, and an interval Px(+) between electron-emitting devices 2(+) on the (+X) side of the spacer 19 are set to satisfy Px(−)=Px(+)=Px.

Two preferable structures for realizing the electron beam traveling method according to the present invention described with reference to FIG. 1 will be explained below. The first structure will be first described with reference to FIG. 2 to FIGS. 5A and 5B, and then the second structure will be described with reference to FIG. 6.

<First Structure>

The first structure is characterized by the arrangement of the electron-emitting devices 2 formed on the substrate 1.

Figure 2:
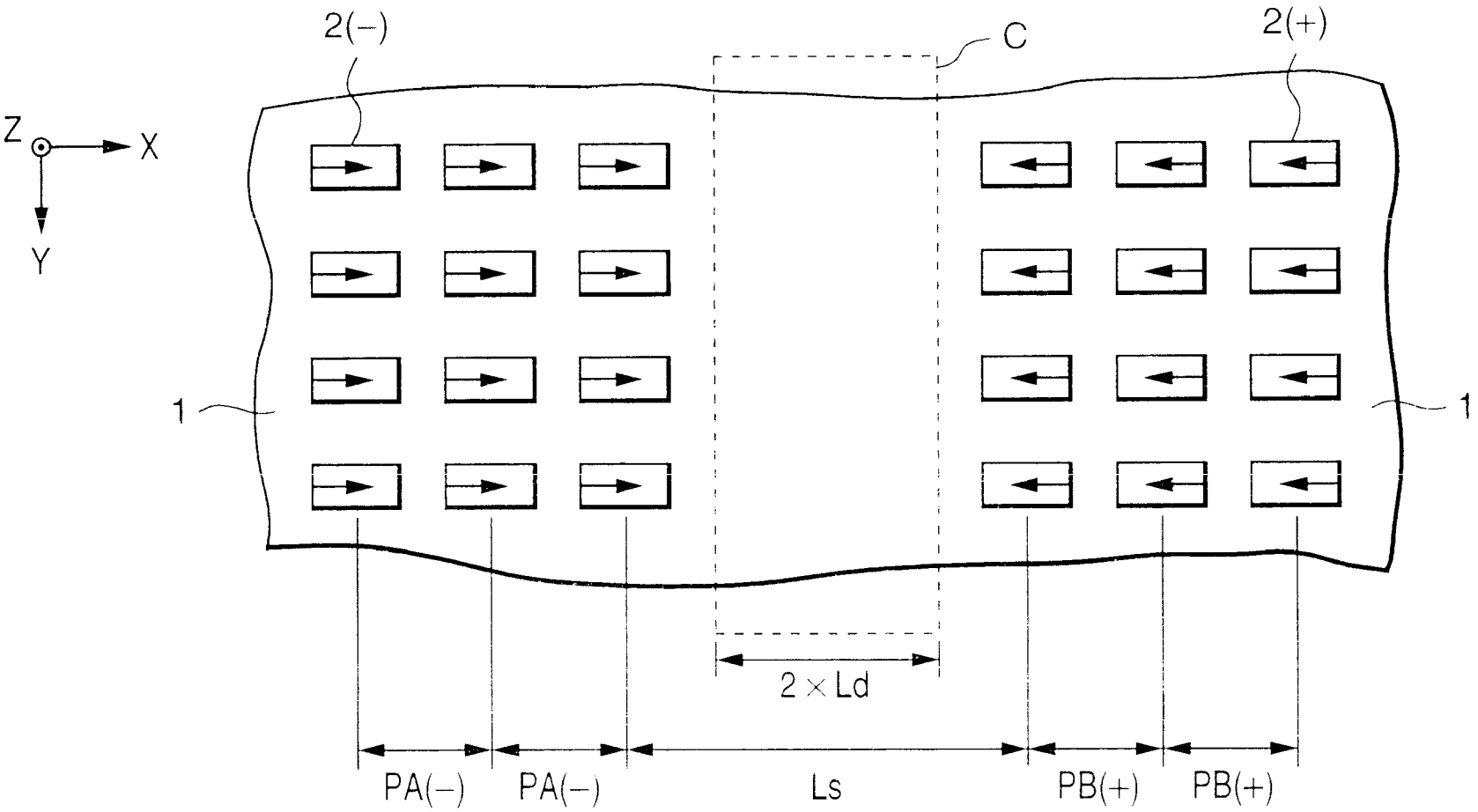
FIG. 2 is a plan view of the concept of the electron source in the present invention.

FIG. 2 is a plan view of the substrate 1 on which the electron-emitting devices 2 are formed. As described above, the interval between electron-emitting devices in the X direction is set to satisfy Px(−)=Px(+)=Px. An interval Ls between electron-emitting devices on both sides of the spacer 19 will be described later.

Electron-emitting devices 2(+) and 2(−) on both sides of the spacer 19 are arranged in directions opposite to each other by 180° along the X direction. (In FIG. 2, each arrow schematically indicates the direction of the electron-emitting device 2, and the direction of the arrow indicates the direction of a vector Ef to be described below).

The structure in FIG. 2 will be explained in more detail below. As the electron-emitting device 2 used in the structure shown in FIG. 2, a device having the following structure is selectively used. In a driven state (in which a driving voltage is applied to the electron-emitting device to emit an electron beam), a potential distribution asymmetrical about the normal line of a plane defined by the substrate 1 that passes through an electron-emitting portion is produced in a space around the electron-emitting portion of the electron-emitting device 2.

Figure 3:
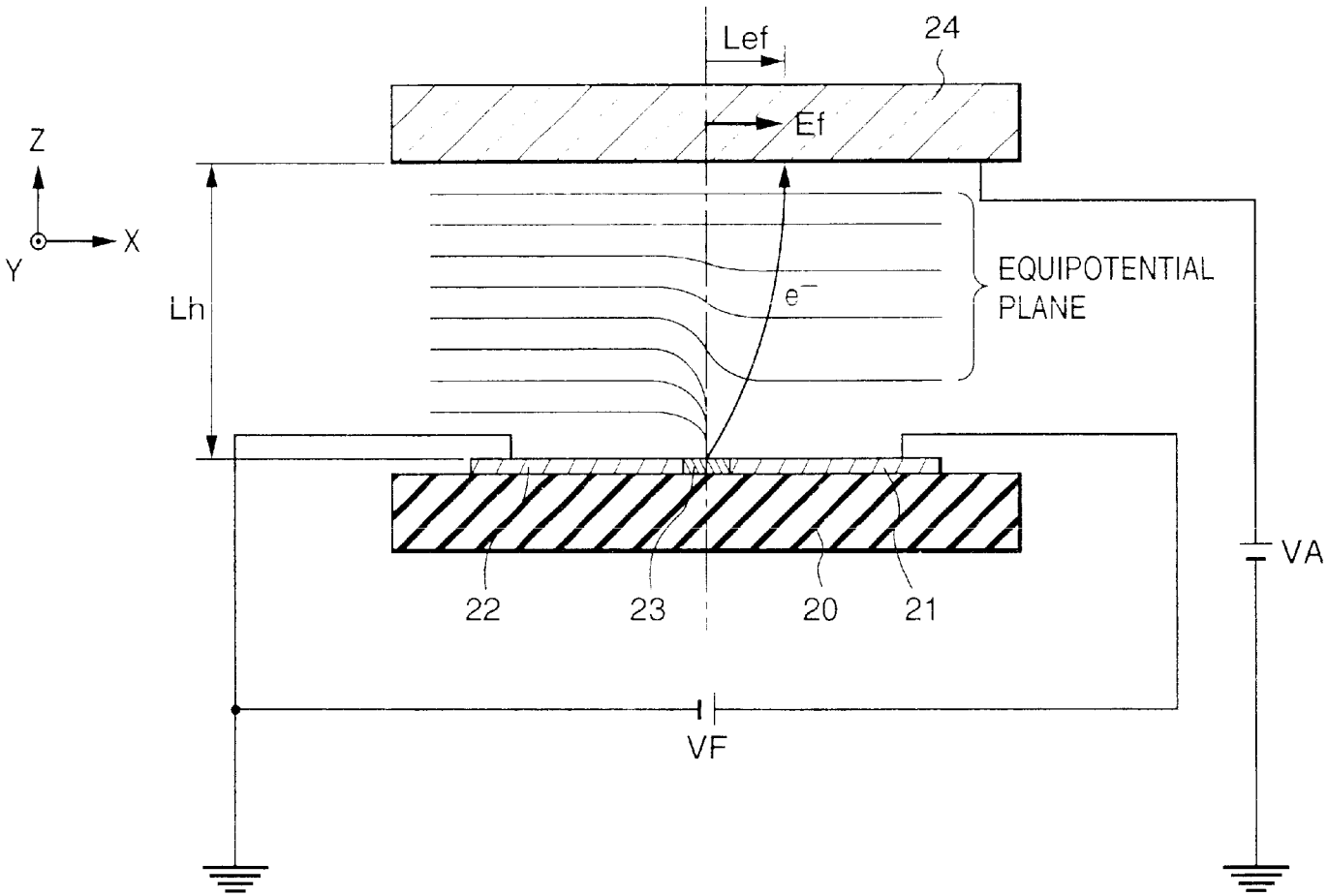
FIG. 3 is a view showing the orbit of an electron beam in an embodiment.

This electron-emitting device will be described in detail with reference to FIG. 3. FIG. 3 is a cross-sectional view for explaining the electron-emitting device used in the present invention. Referring to FIG. 3, numeral 20 denotes a substrate on which the electron-emitting device is arranged; 21, a positive electrode of the electron-emitting device; 22, a negative electrode of the electron-emitting device; 23, an electron-emitting portion of the electron-emitting device; and 24, a target of an electron beam. Symbol VF denotes a power source for applying a driving voltage Vf [V] to the electron-emitting device; and VA, a power source for applying a target voltage Va [V]. (Note that in an actual image display apparatus, the target 24 is a fluorescent substance. In general, the relation: Va>Vf holds.)

The electron-emitting device used in the present invention comprises at least the positive electrode 21, the negative electrode 22, and the electron-emitting portion 23 as constituent members. These constituent members are formed side by side on the upper surface of the substrate 20. (Note that in the following description, the upper surface of the substrate 20 will be called the flat surface of the substrate.)

Figure 29:
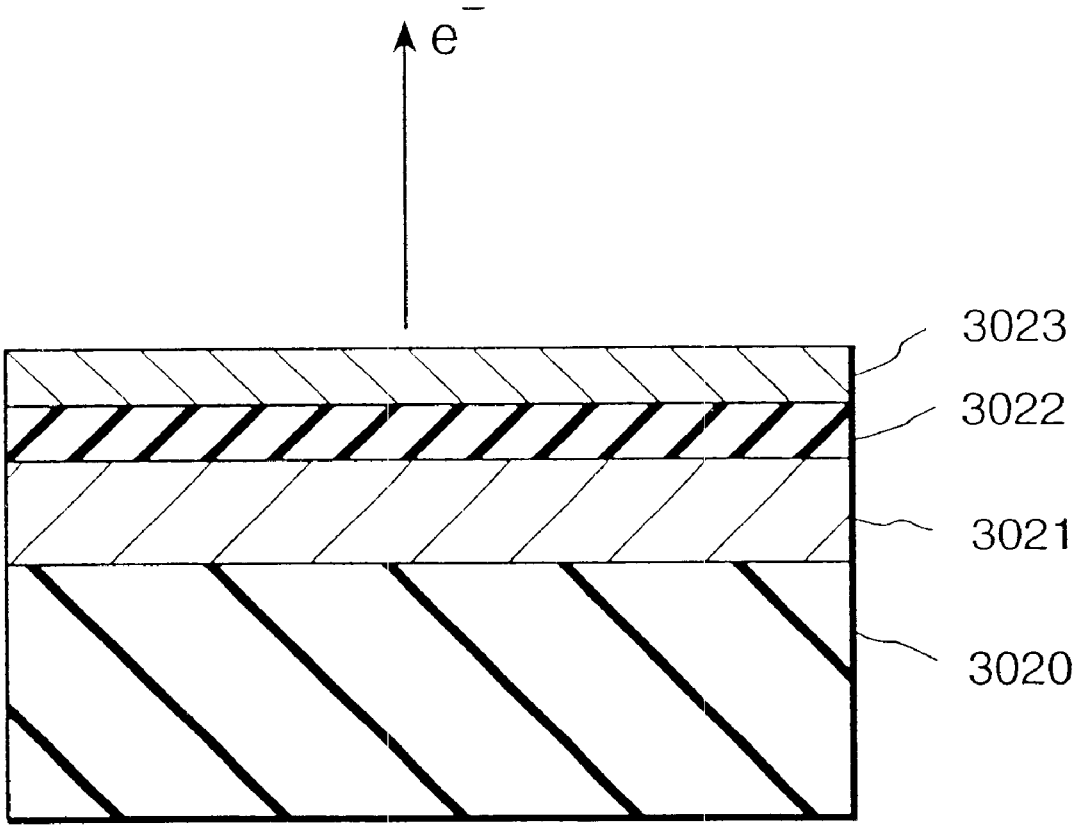
PRIOR ART FIG. 29
FIG. 29 is a cross-sectional view showing an example of a conventionally known MIM type electron-emitting device.
Figure 30:
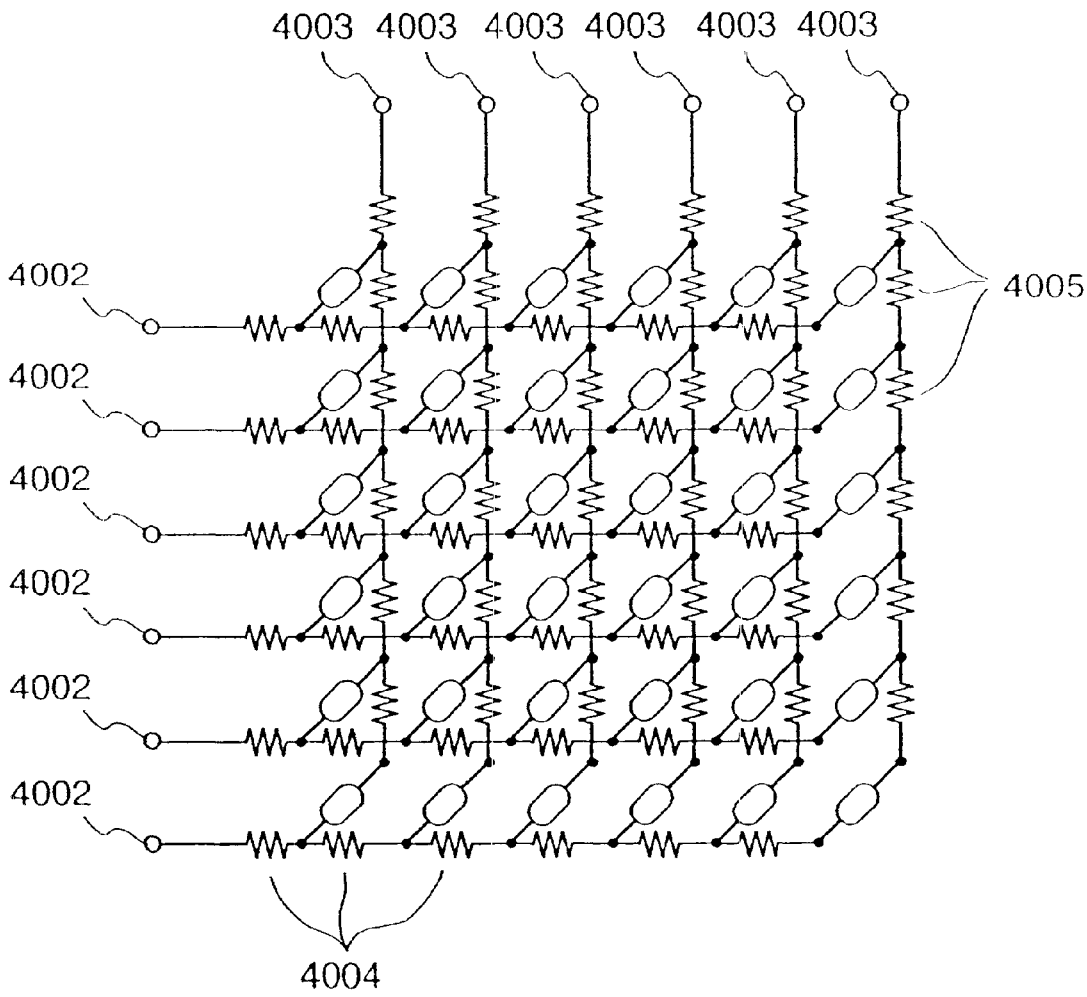
PRIOR ART FIG. 30
FIG. 30 is a view showing wiring of electron-emitting devices.
Figure 31A:
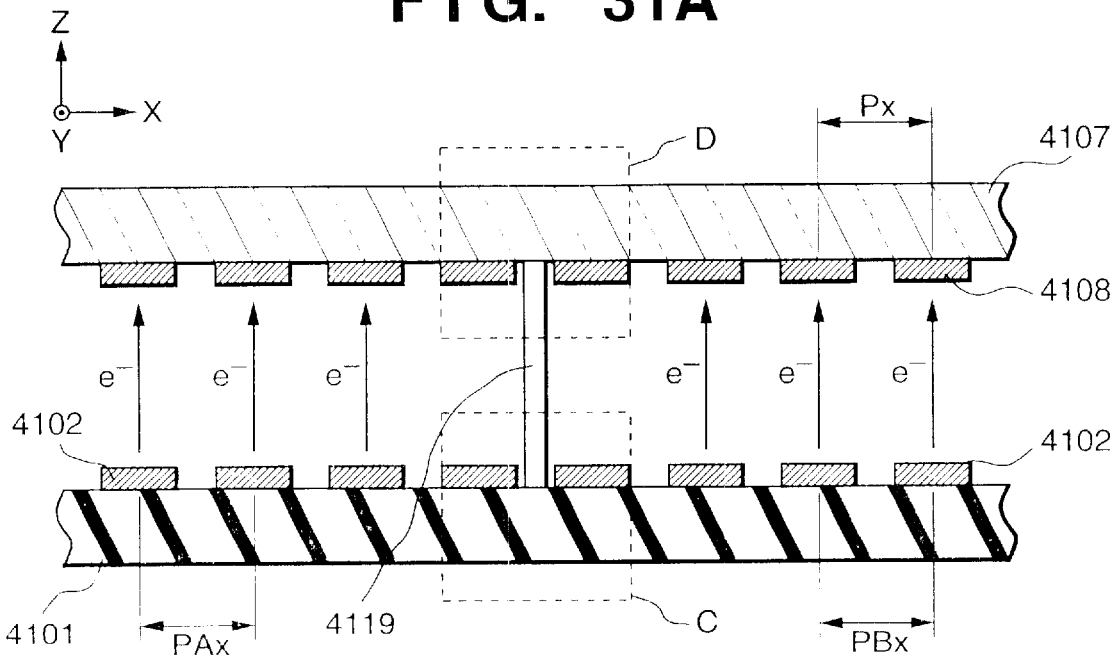
FIGS. 31A and 31B are views showing the generation mechanism of a light emission disabled region.
Figure 31B:
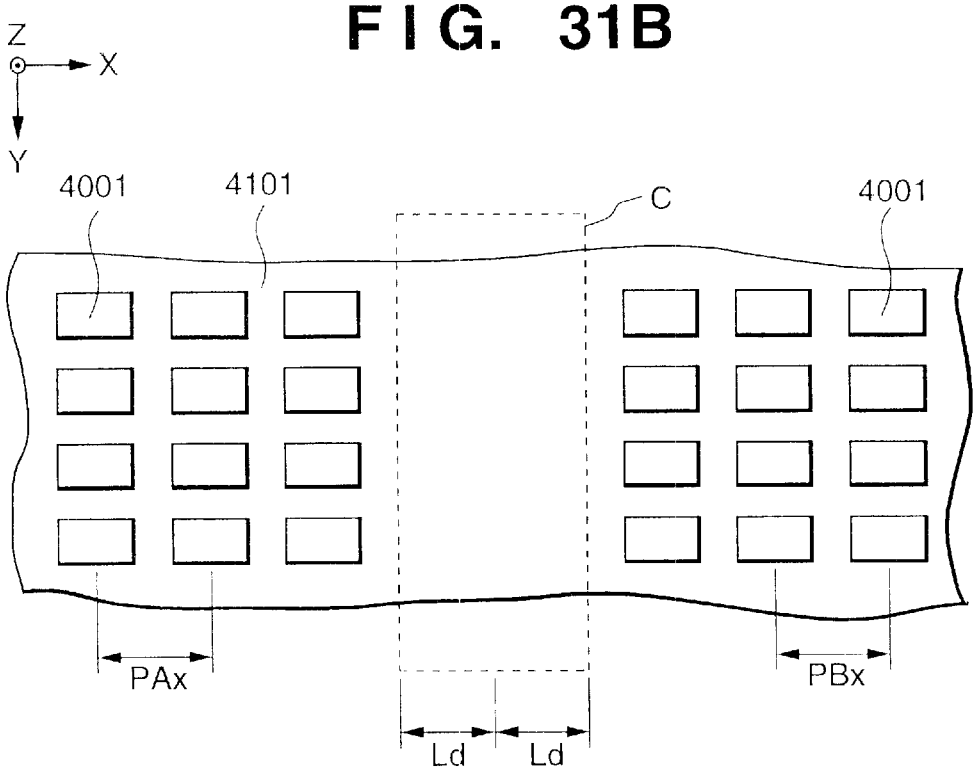

For example, the electron-emitting device in FIG. 28 or 29 has the constituent members stacked vertically on the flat surface of the substrate, and hence does not correspond to the electron-emitting device having the constituent members arranged side by side on the flat surface of the substrate, but the electron-emitting device in FIG. 27 corresponds thereto.

In this electron-emitting device, an electron beam emitted by the electron-emitting portion 23 generally has an initial velocity component in the direction from the negative electrode 22 to the positive electrode 21. The electron beam does not therefore propagate vertically from the flat surface of the substrate.

Further, in this electron-emitting device, since the positive electrode 21 and the negative electrode 22 are arranged side by side on the flat surface of the substrate, a potential distribution produced in a space above the electron-emitting portion 23 upon application of the driving voltage is asymmetrical about a line passing through the electron-emitting portion 23 and vertically extending to the flat surface of the substrate (i.e., a chain line in FIG. 3). FIG. 3 shows a potential distribution, in dotted lines, between the electron-emitting device and the target 24. As shown in FIG. 3, equipotential planes are almost parallel to the flat surface of the substrate near the target 24, but are inclined near the electron-emitting device owing to the influence of the driving voltage Vf [V]. For this reason, an electron beam emitted by the electron-emitting portion 23 simultaneously receives a force based on the inclined potential in the Z direction and a force in the X direction while it travels through the space. The electron beam propagates along a curved orbit like the one shown in FIG. 3.

Figure 4:
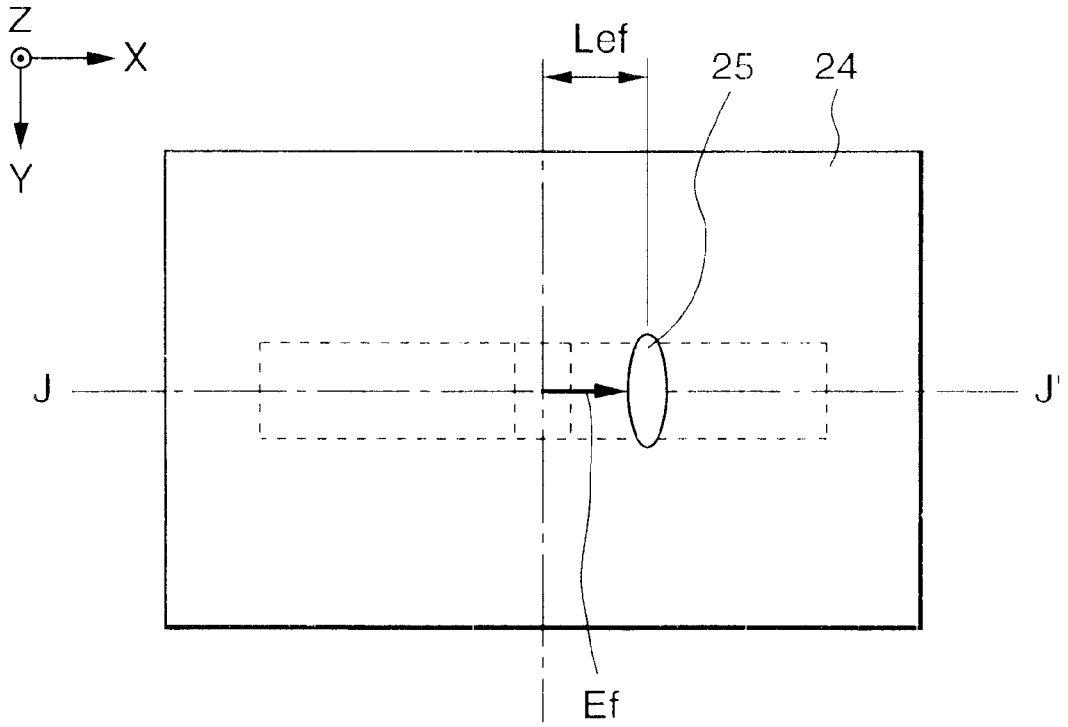
FIG. 4 is a view showing the irradiation distribution of the electron beam in the embodiment when viewed from above.

For the above two reasons, the position where the electron beam irradiated on the target 24 is shifted from the position immediately above the electron-emitting portion by a distance Lef in the X direction. FIG. 4 is a plan view of the target 24 when viewed from above. Referring to FIG. 4, numeral 25 denotes an electron-beam irradiation position on the lower surface of the target. (Note that FIG. 3 is a cross-sectional view cut out the chain line J–J' in FIG. 4.)

For the sake of illustrative convenience, a vector Ef represents the direction and distance of the shift to generalize the manner in which the electron-beam irradiation position on the target is shifted from the position immediately above the electron-emitting portion.

First of all, the direction of the vector Ef coincides with the direction in which the negative electrode, electron-emitting portion, and positive electrode of the electron-emitting device are arranged on the flat surface of the substrate. For example, in FIG. 3, since the negative electrode 22, electron-emitting portion 23, and positive electrode 21 of the electron-emitting device are sequentially arranged on the substrate 20 along the X direction, the direction of the vector Ef coincides with the X direction.

Figure 5A:
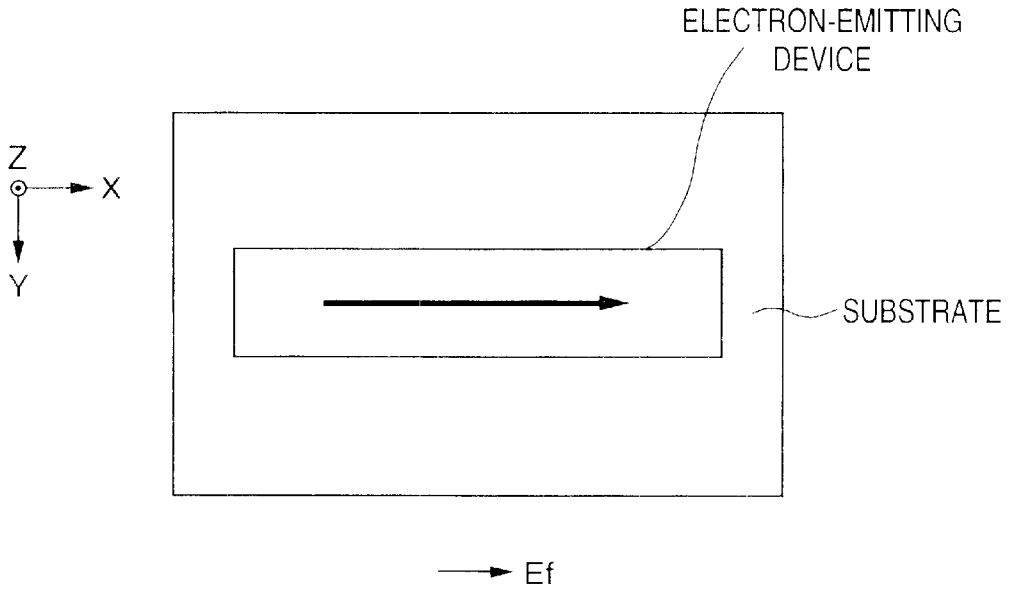
FIGS. 5A and 5B are views showing the electric field vector of an electron-emitting device in the embodiment.
Figure 5B:
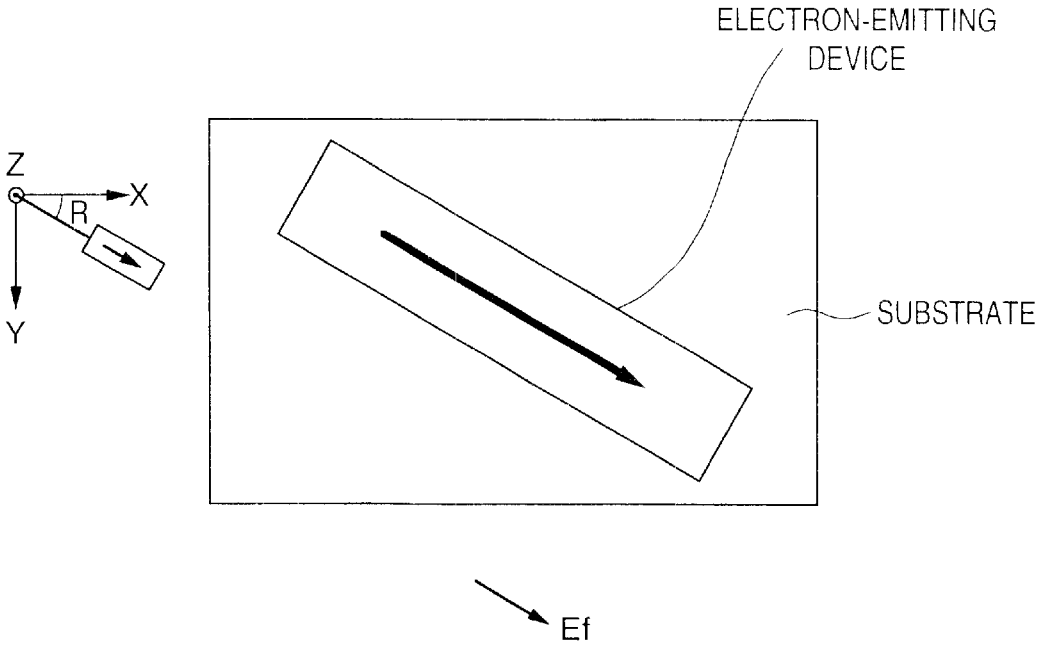

For the sake of illustrative convenience, FIGS. 5A and 5B schematically show the direction in which the electron-emitting device is formed on the flat surface of the substrate, and the direction of the vector Ef. FIG. 5A shows an example wherein the negative electrode, electron-emitting portion, and positive electrode of an electron-emitting device 1 are formed side by side on the flat surface of a substrate along the X direction. FIG. 5B shows an example wherein these constituent members are formed at an angle R with respect to the X direction.

The magnitude (i.e., Lef) of the vector Ef is determined by a distance Lh between the electron-emitting device and the target, a driving voltage Vf for electron emission, a potential Va of the target, the type and shape of the electron-emitting device, and the like. However, this magnitude can be approximately calculated according to equation [1]:

$$Lef=2\cdot K\cdot Lh\cdot SQRT(Vf/Va) \quad [1]$$

where SQRT(Vf/Va): the square root of Vf/Va,

Lh [m]: the distance between the electron-emitting device and the target,

Vf [V]: the driving voltage applied to the electron-emitting device,

Va [V]: the voltage applied to the target, and

K: a constant determined by the type and shape of the electron-emitting device.

In obtaining an approximate value according to equation [1], if the type and shape of an electron-emitting device to be used are unknown, K=1 is substituted into the equation.

On the contrary, if the type and shape of the electron-emitting device are known, the constant K of the electron-emitting device is determined by an experiment or computer simulation.

In order to obtain the magnitude Lef with higher precision, the value K is preferably used as a function of Vf instead of the constant. In many cases, however, it suffices to use the constant K for the precision required to design an image display apparatus.

For the above description, the structure in FIG. 2 will be supplementarily explained. The electron-emitting device 2(−) is formed at R=0° on the (−X) side of the spacer 19, whereas the electron-emitting device 2(+) is formed at R=180° on the (+X) side of the spacer 19. The distance Ls between electron-emitting devices facing each other via the spacer 19 is set to a value determined by equation [2]:

$$Ls=Px+(2\cdot Lef) \quad [2]$$

where Px: the interval between pixels, and

Lef: the distance determined by equation [1].

As is obvious from equations [1] and [2], the distance Ls can be set to a satisfactory size by setting proper conditions. That is, in the above-mentioned first structure, generation of a light emission disabled region can be prevented without any electron-emitting device near the spacer.

The first structure for realizing the electron beam traveling method of the present invention shown in FIG. 1 has been described.

<Second Structure>

The second structure for realizing the structure in FIG. 1 will be explained with reference to FIG. 6. The second structure is characterized by a deflection electrode for deflecting an electron beam toward the spacer.

Figure 6:
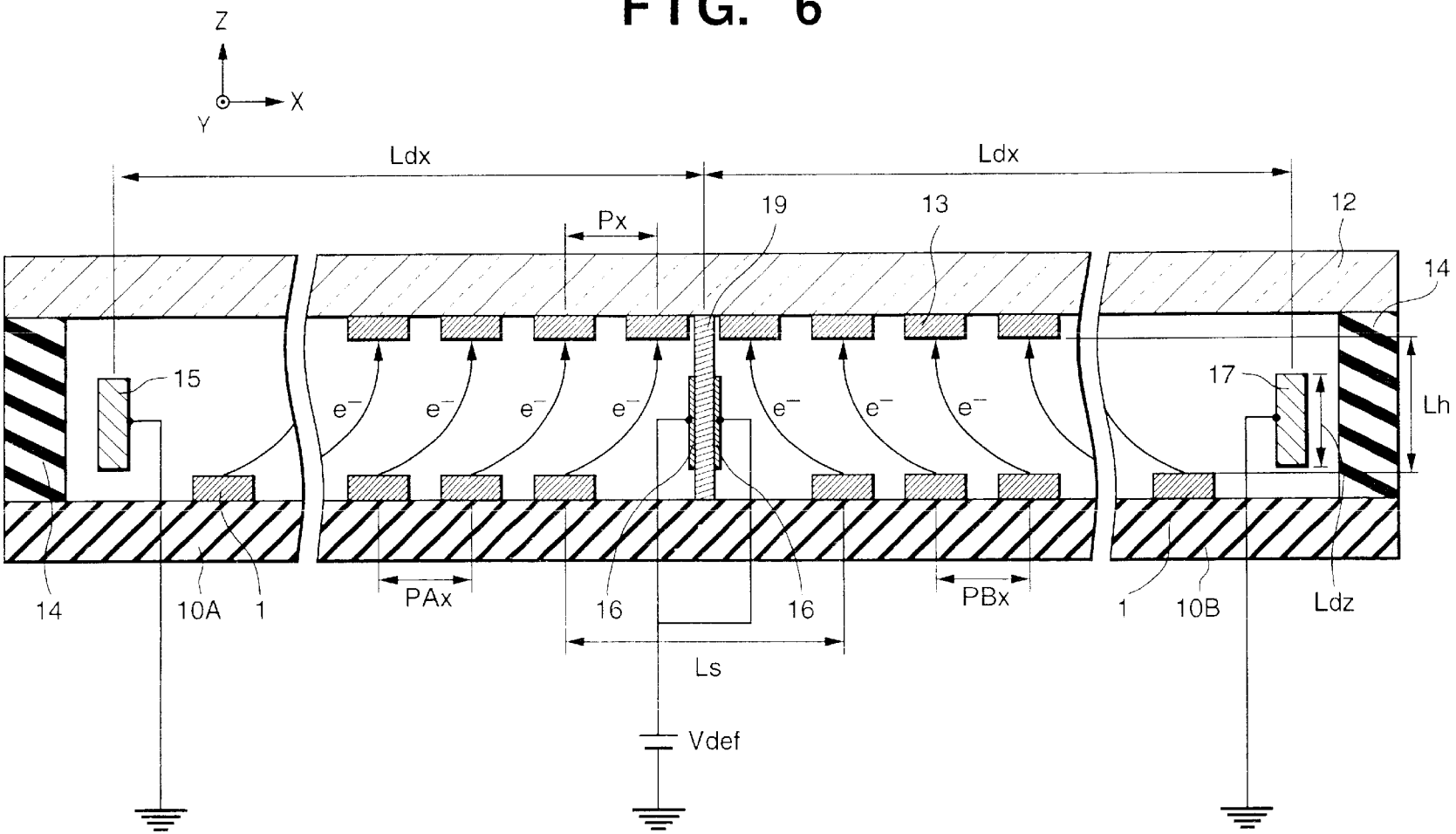
FIG. 6 is a cross-sectional view of the structure of an electron source in the se con d embodiment.

FIG. 6 is a cross-sectional view showing an image display apparatus having the second structure. The same reference numerals as in FIG. 1 denote the same parts in FIG. 6. Referring to FIG. 6, numeral 14 denotes each side wall of the image display apparatus; and 15, 16, and 17, deflection electrodes for deflecting electron beams. Symbol Vdef denotes a deflection voltage source.

In this structure, a beam emitted by each electron-emitting device 1 can be deflected toward the spacer 19 by applying a proper deflection voltage across the deflection electrodes to allow the spacer side to have a higher potential.

Even if, therefore, no electron-emitting device is arranged near the spacer 19, a fluorescent substance can be illuminated with an electron beam to prevent generation of a light emission disabled region. The second structure will be explained in more detail below.

Letting Px be the interval between pixels of the face plate 7 in the X direction, PAx be the interval between electron-emitting devices on a substrate 10A, and PBx be the interval between electron-emitting devices on a substrate 10B, these values are set to satisfy PAx=PBX=Px.

In an electron-emitting device used in the second structure, a positive electrode, a negative electrode, and an electron-emitting portion may be stacked vertically on the flat surface of the substrate, unlike the first structure. As the electron-emitting device in the second structure, the electron-emitting device shown in FIG. 28 or 29 can be employed.

The deflection electrodes 16 are located on the sides of the spacer 19. The deflection electrodes 15 and 17 are arranged to be spaced apart from the corresponding deflection electrodes 16 by a distance Ldx in the X direction. Each deflection electrode has a height Ldz.

In this structure, the interval Ls between electron-emitting devices arranged on the two sides of the spacer 19 is approximately set by equation [3]:

$$Ls=Px+(2\cdot Vdef\cdot Lh\cdot Ldz)/(Va\cdot Ldx) \quad [3]$$

where Px [m]: the interval between the pixels in the X direction,

Lh [m]: the distance between the electron-emitting device and the fluorescent substance, Ldx [m]: the distance between the deflection electrodes, Ldz [m]: the height of the deflection electrode, Va [V]: the voltage applied to the fluorescent substance, and Vdef [V]: the voltage applied to the deflection electrode.

If the height Ldz of the deflection electrode is greatly different from the distance Lh between the electron-emitting device and the fluorescent substance, a correction term is desirably set in equation [3].

As is apparent from equation [3], the distance Ls can be set to a satisfactory size by setting proper conditions. That is, generation of a light emission disabled region can be prevented without any electron-emitting device near the spacer.

The second structure for realizing the electron beam traveling method according to the present invention shown in FIG. 1 has been described.

A combination of the first and second structures can be employed.

A preferred form of the electron-emitting device used in the first structure of the present invention will be described below.

The electron-emitting device used in the first structure comprises a positive electrode, a negative electrode, and an electron-emitting portion as constituent members, which are formed side by side on the flat surface of the substrate. (Note that part of the negative electrode may also serve as an electron-emitting portion.)

As a device satisfying these requirements, a surface-conduction emission (SCE) type electron-emitting device, a lateral field emission type electron-emitting device, or the like is available. An SCE type electron-emitting device and a lateral field emission type electron-emitting device will be described in the order named.

SCE type electron-emitting devices include, for example, a device in the form shown in FIG. 27 and a device having fine particles near an electron-emitting portion. The former device includes known devices made of various materials, as described in "DESCRIPTION OF THE RELATED ART". All these devices are suitable as electron-emitting devices used in the first structure. Materials, structures, and manufacturing methods for devices associated with the latter device will be described in detail in the following form. All these devices are suitable for electron-emitting devices used in the first structure. That is, in practicing the first structure, when an SCE type electron-emitting device is to be used, there are no limitations on materials, structures, manufacturing methods, and the like for the device.

Figure 9A:
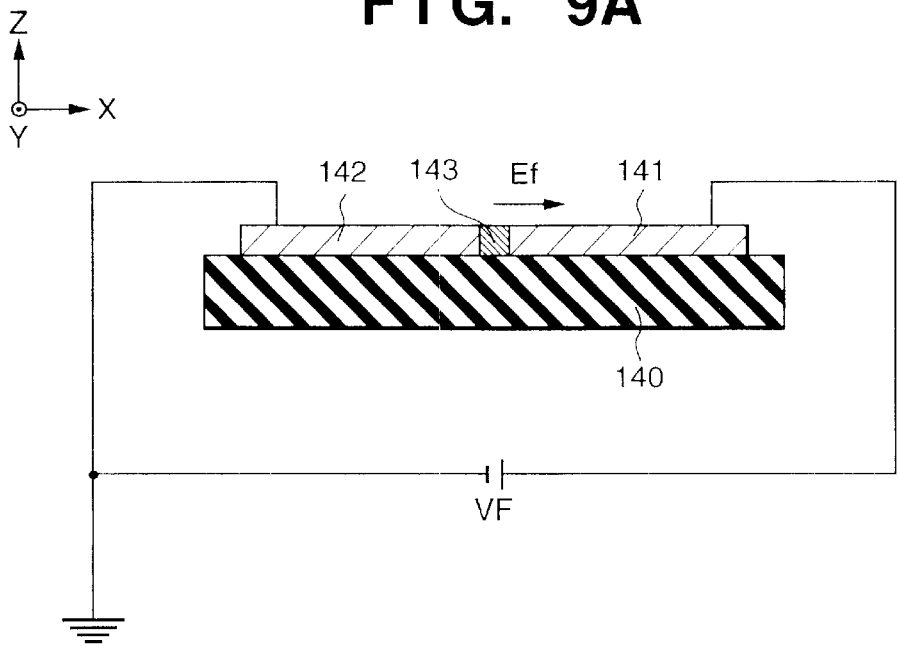
FIGS. 9A and 9B are views showing the direction of a surface-conduction emission type electron-emitting device in the embodiment.
Figure 9B:
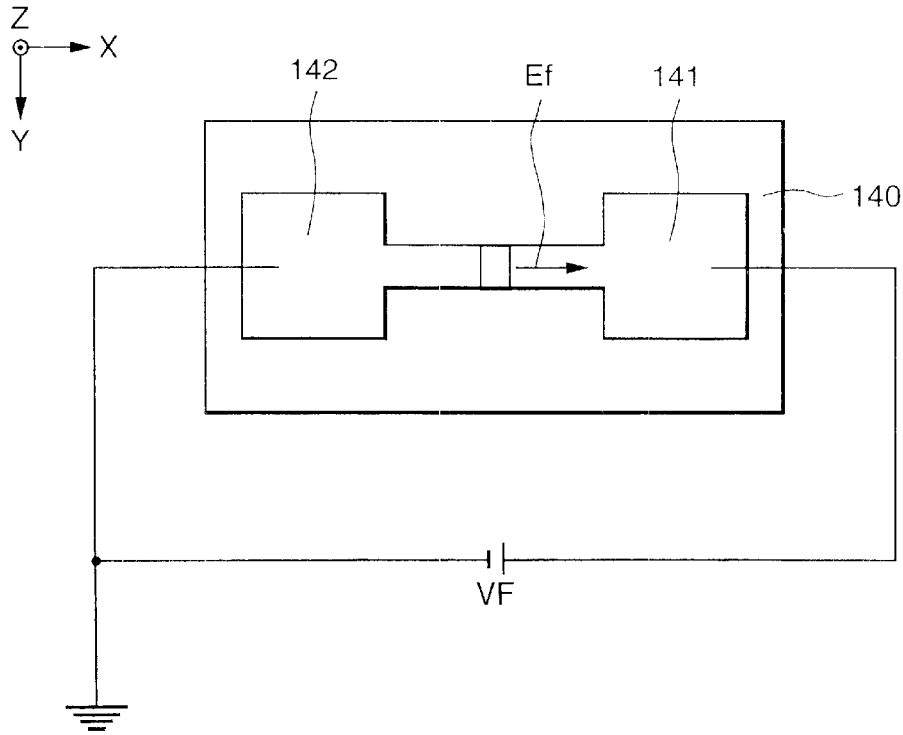

As for an SCE type electron-emitting device, FIGS. 9A and 9B show the vector Ef indicating the direction in which an electron beam is deflected. FIG. 9A is a cross-sectional view. FIG. 9B is a plan view. Referring to FIGS. 9A and 9B, numeral 140 denotes a substrate; 141, a positive electrode; 142, a negative electrode; and 143, an electron-emitting portion. Symbol Vf denotes a power source for applying a driving voltage to the device.

Figure 10A:
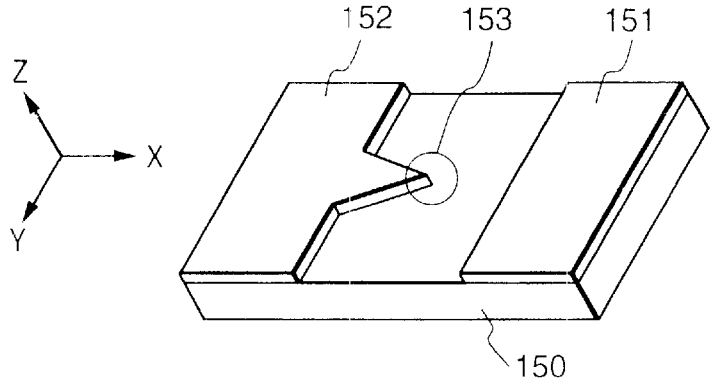
FIGS. 10A to 10C are views showing examples of a preferable lateral field emission type electron-emitting device in the embodiment.
Figure 10B:
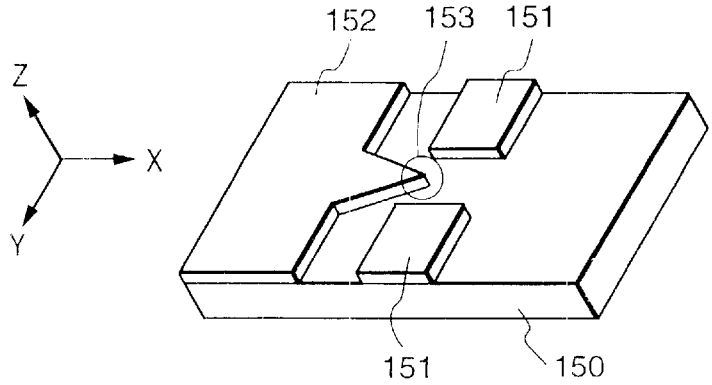
Figure 10C:
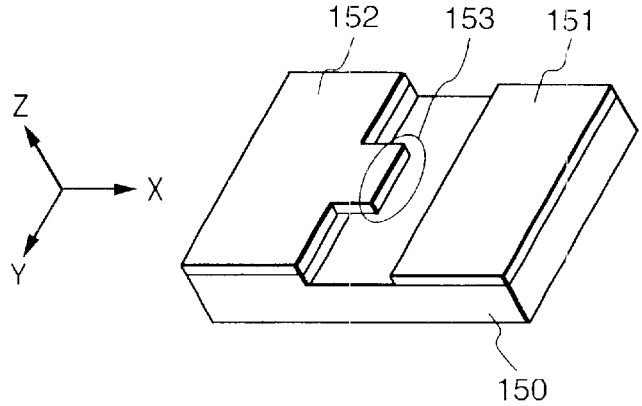

A lateral field emission type electron-emitting device is, of field emission type electron-emitting devices, a device in which a negative electrode, an electron-emitting portion, and a positive electrode are arranged side by side along the flat surface of a substrate. For example, the device shown in FIG. 28 has a negative electrode, an electron-emitting portion, and a positive electrode which are arranged in a direction perpendicular to the flat surface of a substrate, and hence is not categorized as a lateral type. To the contrary, devices shown in FIGS. 10A to 10C are categorized as a lateral type. FIGS. 10A to 10C are perspective views showing typical lateral type electron-emitting devices formed on the flat surfaces of substrates along the X direction. Referring to 10A to 10C, numeral 150 denotes a substrate; 151, a positive electrode; 152, a negative electrode, and 153, an electron-emitting portion. There are lateral type electron-emitting devices having various shapes other than those shown in FIGS. 10A to 10C. That is, any device designed to deflect the orbit of an electron beam from the vertical direction is suitable for a device used in the first structure. Therefore, a device obtained by adding a modulation electrode for modulating the intensity of an electron beam to each of the forms shown in FIGS. 10A to 10C may be used. In addition, part of the negative electrode 152 may also serve as the electron-emitting portion 153, or a member added to the negative electrode may be used as the electron-emitting portion 153. As a material for the electron-emitting portion of a lateral type electron-emitting device, a refractory metal, diamond, or the like maybe used. However, the material is not limited to them, and any material which allows proper emission of electrons can be used.

Figure 11A:
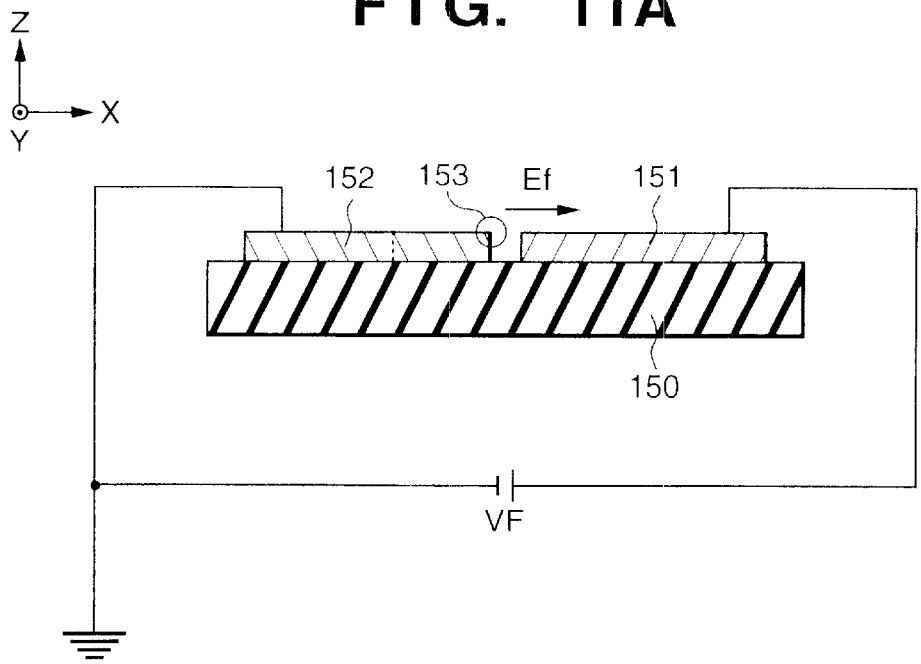
FIGS. 11A and 11B are views showing the direction of the lateral field emission type electron-emitting device.
Figure 11B:
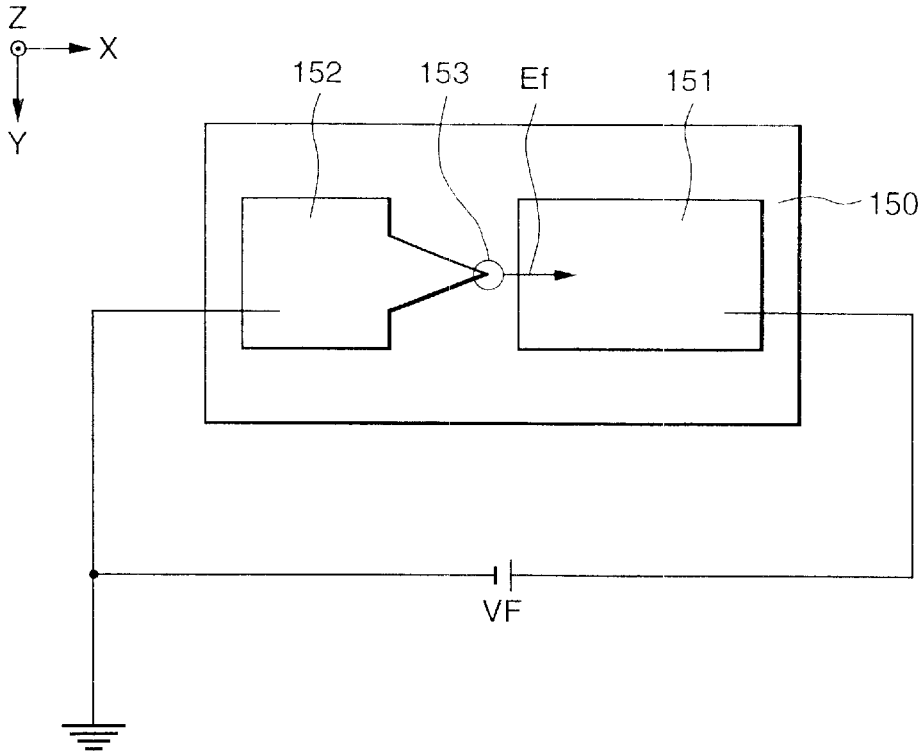

As for the lateral field emission type electron-emitting device, FIGS. 11A and 11B show the direction of the vector Ef indicating a direction in which an electric beam is deflected. FIG. 11A is a cross-sectional view. FIG. 11B is a plan view. Referring to FIGS. 11A and 11B, numeral 150 denotes a substrate; 151, a positive electrode; 152, a negative electrode; and 153, an electron-emitting portion. Symbol VF denotes an electrode for applying a driving voltage to the device. The form of the first structure of the present invention has been described.

<General Description of Second Structure>

The essence of the second structure is to arrange deflection electrodes for deflecting an electron beam toward the spacer. The structure of the deflection electrodes is not limited to the one in FIG. 6. The form of an electron-emitting device used in the second structure will be described below.

In practicing the second structure, a device need not have a positive electrode, an electron-emitting portion, and a negative electrode which are formed side by side on the flat surface of a substrate, unlike the first structure. As the device used in the second structure, the electron-emitting device shown in FIG. 28, the MIM type device shown in FIG. 29 is available. Of course, an SCE type electron-emitting device or a lateral field emission type electron-emitting device used in the first structure is also available. In addition, a semiconductor electron-emitting device having a p-n junction can also be used. In short, the second structure can employ any device as far as the device can emit an electron beam strong enough to satisfactorily excite a fluorescent substance of an image display apparatus, and devices can be formed on a substrate at a high density.

Description of Embodiments

Embodiments of the present invention will be described below on the basis of the schematic structure of the present invention described above.

<First Embodiment>

Figure 12:
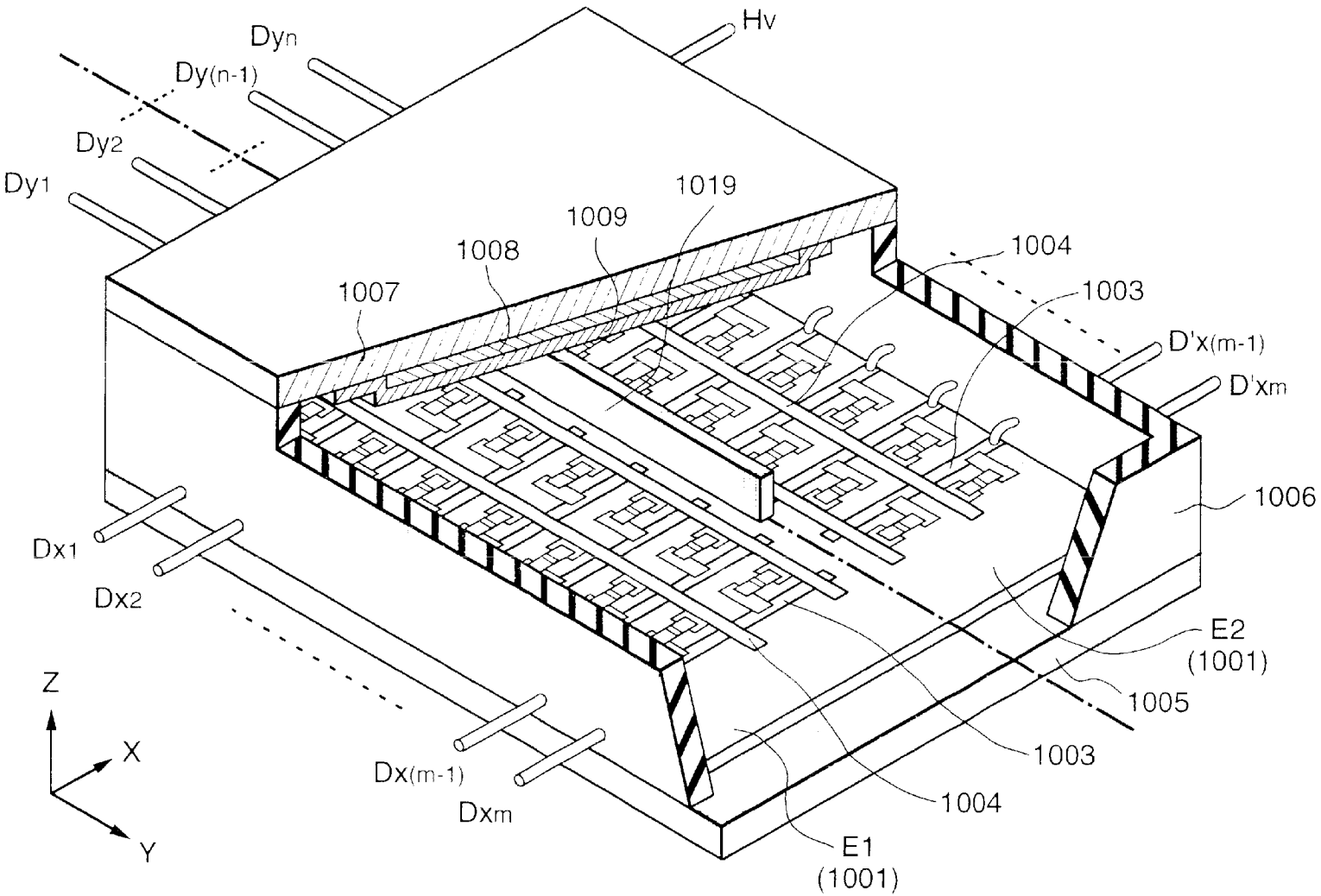
FIG. 12 is a partially cutaway view of an image display apparatus in e the embodiment.

FIG. 12 shows the structure of the first embodiment of the present invention. FIG. 12 is a perspective view of a display panel using one spacer where a portion of the panel is removed for showing the internal structure of the panel. The display panel adopts the structure shown in FIGS. 1 to 4 as the arrangement of electron-emitting devices and the spacer on a substrate serving as an electron source.

Regarding this display panel, the arrangement of pixels, the arrangement of the electron-emitting devices, the structure and manufacturing method of the display panel, the structure, manufacturing method, and characteristics of the electron-emitting device, the structure of the substrate serving as an electron source, and a method of driving the display panel will be explained below in the order named.

<Arrangement of Pixels>

On this display panel, pixels were arranged at the following interval.

Figure 7:
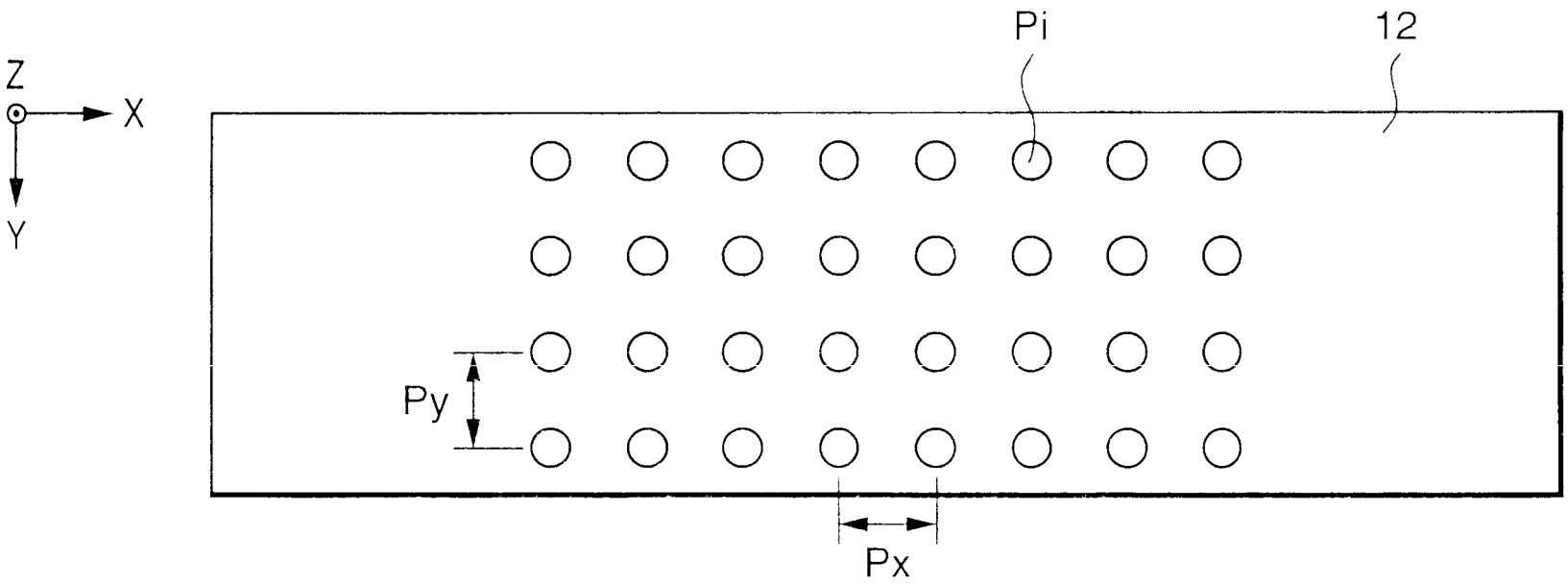
FIG. 7 is a view showing the distribution of light emitted dots of a display panel in the embodiment.

Referring to a plan view of FIG. 7 showing the distribution of light emitted dots, Px=0.5 mm Py=0.5 mm <Arrangement of Electron-Emitting Device>

Figure 8:
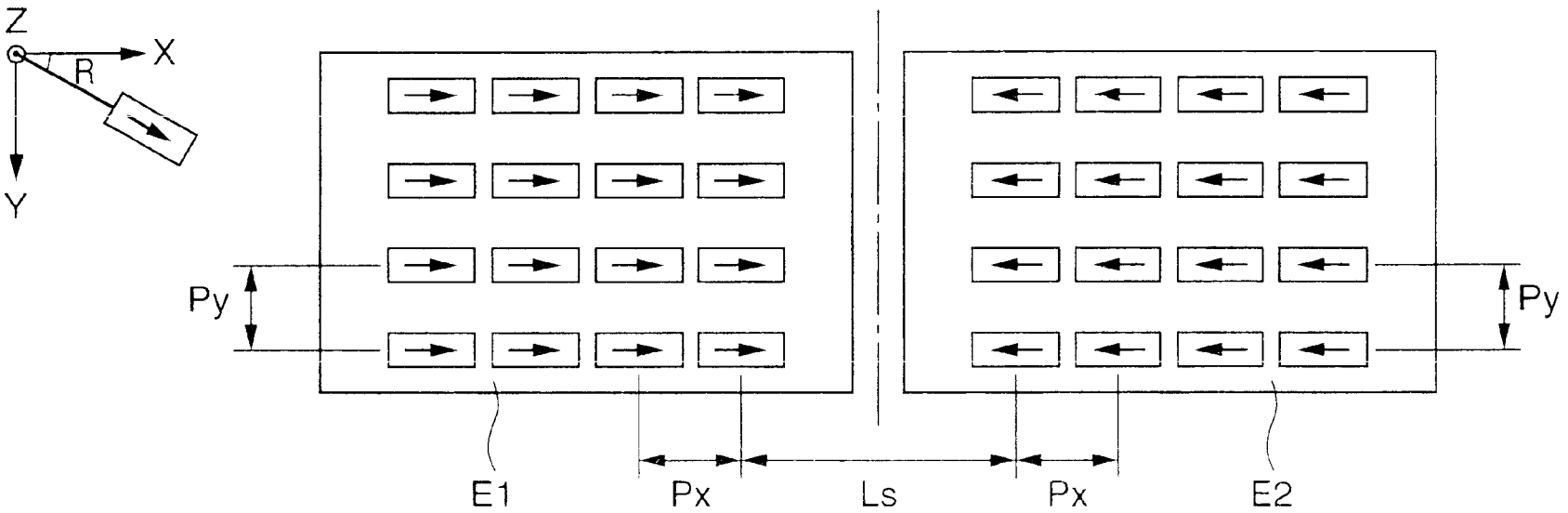
FIG. 8 is a view showing the arrangement of electron-emitting devices in the embodiment.

On this display panel, electron-emitting devices were laid out as follows. Referring to a plan view of FIG. 8 showing the arrangement of the electron-emitting devices, Px=Py=0.5 mm Ls=10.5 mm

R(E1)=0°

R(E2)=180°

These values were determined based on the following design guidelines.

A fluorescent substance and an electron-emitting device used in the display panel were selected. More specifically, a material P-22 excellent in fluorescence efficiency and color purity was used as a fluorescent material, and an SCE type electron-emitting device excellent in electron-emitting characteristics and easy to manufacture was used as an electron-emitting device.

Driving conditions necessary to achieve the maximum luminance required as the performance of a display panel were obtained (in the following description, x^y indicates the yth power of x).

For example, if the luminous efficiency of the fluorescent substance P-22 is 8 lm/W, for a maximum luminance of 100 Cd/m^2 power per unit area to be applied to the fluorescent substance is calculated to be 39 W/m^2. Based on this, a voltage Va [V] to be applied to the fluorescent substance, and a voltage to be applied to the SCE type electron-emitting device were determined. That is, for Va=5 kV, an electron beam of 7.8×10^3 A/m^2 per unit area must be irradiated on the fluorescent substance from the SCE type electron-emitting device. The number of devices per unit area of the SCE type electron-emitting device is set to 4×10^6 devices/m^2 on the basis of the pixel intervals. Since the electron-emitting devices are driven by a scanning method in units of lines, achieving the maximum luminance requires an electron beam output of 3.9×10^−6 A per device. Accordingly, a proper SCE type electron-emitting device capable of outputting an electron beam with this magnitude was designed, and the device driving voltage Vf [V] was set to 20 V. The distance Lh between the fluorescent substance and the electron source substrate was set to 40 mm.

These driving conditions were substituted into equations [1] and [2] above to calculate the distance Ls. Ls=10.5 mm was determined to be a distance long enough to solve the conventional problems, and was employed as a design value. If the size of Ls is determined to be insufficient, the design parameters Va, Vf, Vh of the SCE type electron-emitting device, and the like are properly redesigned to obtain satisfactory Ls.

<Construction of Display Panel and Manufacturing Method>

The construction and manufacturing method of the display panel in FIG. 12 will be explained. In FIG. 12, numeral 1005 denotes a rear plate; 1006, a side wall; and 1007, a face plate. These parts form an airtight container for maintaining the inside of the display panel vacuum. To construct the airtight container, it is necessary to seal-connect the respective parts to obtain sufficient strength and maintain airtight condition. For example, a frit glass is applied to junction portions, and sintered at 400 to 500° C. in air or nitrogen atmosphere, thus the parts are seal-connected. A method for exhausting air from the inside of the container will be described later.

The rear plate 1005 has an electron source substrate 1001 (having different layouts on the E1 and E2 sides) fixed there. On the electron source substrate 1001, M SCE type electron-emitting devices are provided. The respective devices are wired in a matrix by row-direction wiring 1003 and column-direction wiring 1004. If this electron source substrate is called a multi electron-beam source, this multi electron-beam source comprises N×M SCE type electron-emitting devices. Numeral 1019 denotes a spacer serving as a structure resistant to the atmospheric pressure, which is installed between the electron source substrate 1001 and the face plate 1007.

This display panel adopts a flat or step SCE type electron-emitting device, which will be described in detail later.

Figure 13A:
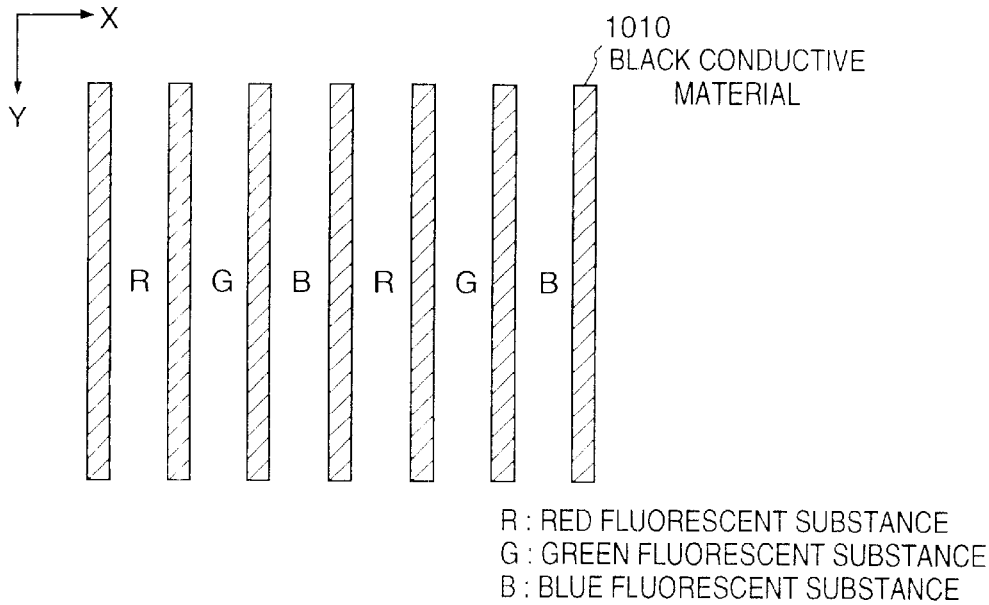
FIGS. 13A and 13B are plan views showing examples of the arrangement of fluorescent substances on the face plate of the display panel.
Figure 13B:
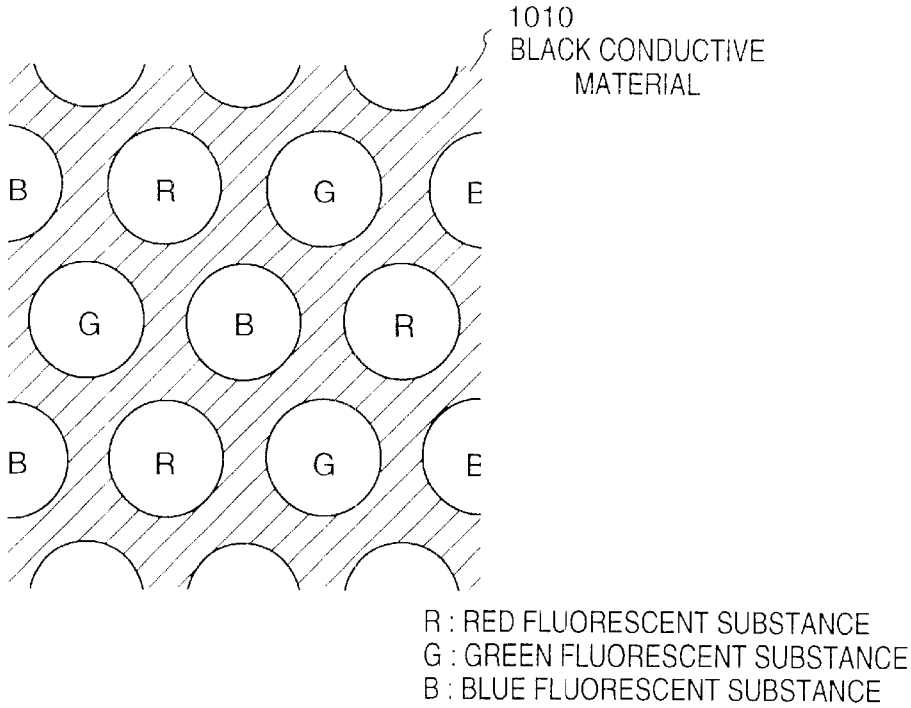

Further, a fluorescent film 1008 is formed under the face plate 1007. As this embodiment assumes a color display apparatus, the fluorescent film 1008 is colored with red, green and blue (three primary colors) fluorescent substances. The fluorescent substance portions are in stripes as shown in FIG. 13A, and black conductive material 1010 is provided between the stripes. The object of providing the black conductive material 1010 is to prevent shifting of display color even if the electron-beam irradiation position is shifted to some extent, to prevent degradation of display contrast by shutting off reflection of external light, to prevent charge-up of the fluorescent film by electron beams, and the like. The black conductive material 1010 mainly comprises graphite;

however, any other materials may be employed so far as the above object can be attained.

Note that when a monochrome display panel is formed, a single-color fluorescent substance may be applied to the fluorescent film 1008, and the black conductive material may be omitted.

Further, a metal back 1009, which is well-known in the CRT field, is provided on the rear plate side surface of the fluorescent film 1008. The object of providing the metal back 1009 is to improve light-utilization ratio by mirror-reflecting a part of light emitted from the fluorescent film 1008, to protect the fluorescent film 1008 from collision between negative ions, to use the metal back 1009 as an electrode for applying an electron-beam accelerating voltage, to use the metal back 1009 as a conductive path for electrons which excited the fluorescent film 1008, and the like. The metal back 1009 is formed, after forming the fluorescent film 1008 on the face plate 1007, by smoothing the fluorescent film front surface, and vacuum-evaporating Al thereon. Note that in a case where the fluorescent film 1008 comprises fluorescent material for low voltage, the metal back 1009 is not used.

Further, for application of accelerating voltage or improvement of conductivity of the fluorescent film, transparent electrodes may be provided between the face plate 1007 and the fluorescent film 1008, although the embodiment does not employ such electrodes.

In FIG. 12, symbols Dx1 to Dxm, Dx1' to Dxm', Dy1 to Dyn and Hv denote electric connection terminals for airtight structure provided for electrical connection of the display panel with an electric circuit (not shown). The terminals Dx1 to Dxm and Dx1' to Dxm' are electrically connected to the row-direction wiring 1003 of the multi electron-beam source; Dy1 to Dyn, to the column-direction wiring 1004; and Hv, to the metal back 1009 of the face plate.

To exhaust air from the inside of the airtight container and make the inside vacuum, after forming the airtight container, an exhaust pipe and a vacuum pump (both not shown) are connected, and exhaust air from the airtight container to vacuum at about $10^{-7}$ Torr. Thereafter, the exhaust pipe is sealed. To maintain vacuum condition inside of the airtight container, a getter film (not shown) is constructed, immediately before/after the sealing. To maintain the vacuum condition inside of the airtight container, a getter film (not shown) is formed at a predetermined position in the airtight container. The getter film is a film formed by heating and evaporating getter material mainly including, e.g., Ba, by heating or high-frequency heating. The suction-attaching operation of the getter film maintains the vacuum condition in the container at $1\times10^{-5}$ or $1\times10^{-7}$ Torr.

The basis structure and manufacturing method of the display panel according to the first embodiment of the present invention is described as above.

<Structure, Manufacturing Method, and Characteristics of Electron-Emitting Device>

Next, an SCE type electron-emitting device used in the display panel of the first embodiment will be explained. The present inventors have found that an SCE type electron-emitting device in which a peripheral portion is formed of a fine particle film is excellent in electron-emitting characteristics and easy to design and manufacture. That is, this type of electron-beam device is the most appropriate electron-beam source to be employed in a multi electron-beam source of a large-screen and high-luminance image display apparatus. A display panel was fabricated using flat SCE type electron-emitting devices formed of a fine particle film to obtain very good results. Flat and step SCE type electron-emitting devices formed of a fine particle film will be described in detail below.

<Flat SEC Type Electron-Emitting Device>

Figure 14A:
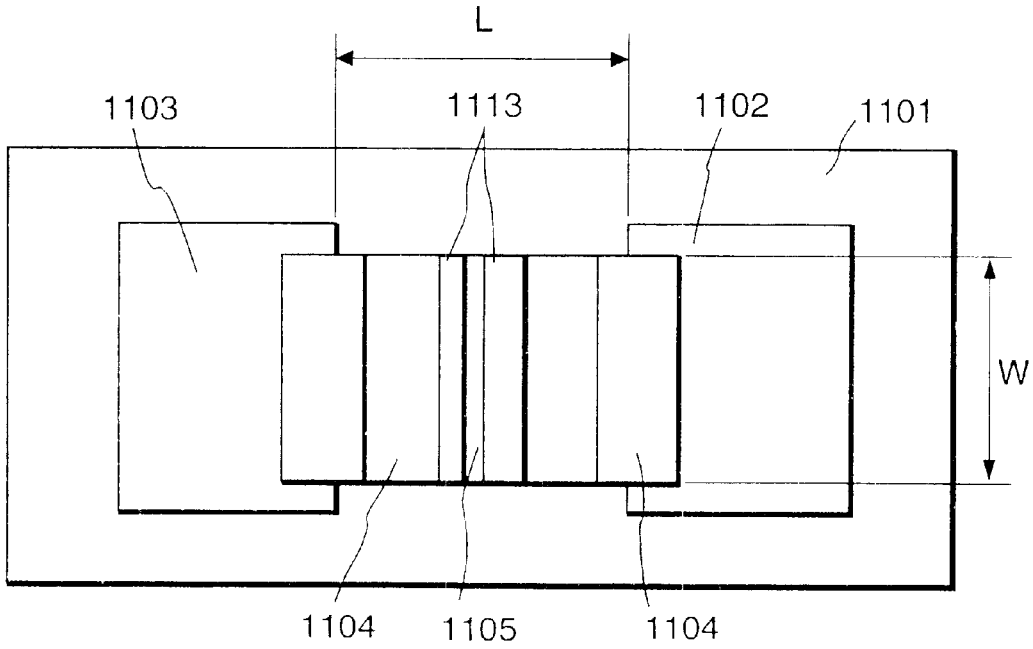
FIGS. 14A and 14B are a plan view and a cross-sectional view, respectively, of a flat surface-conduction emission type electron-emitting device used in the embodiment.
Figure 14B:
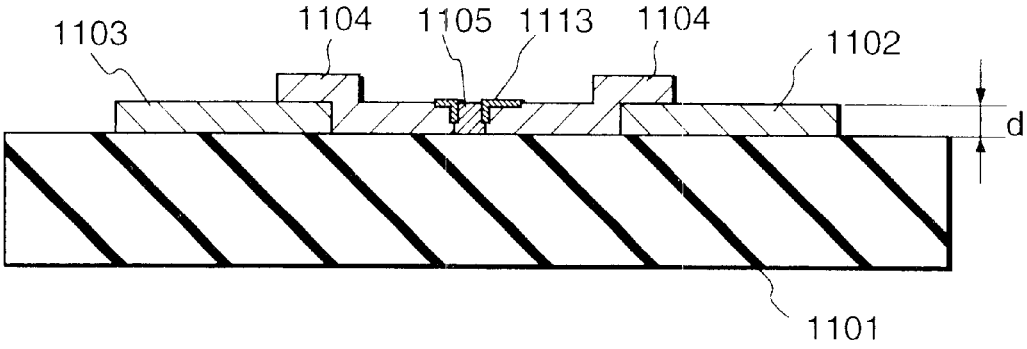

First, the structure and manufacturing method of a flat SCE type electron-emitting device will be described. FIGS. 14A and 14B are views for explaining the structure of the flat SCE type electron-emitting device. FIG. 14A is a plan view; and FIG. 14B, across-sectional view of the device. In FIGS. 14A and 14B, numeral 1101 denotes a substrate; 1102 and 1103, device electrodes; 1104, a conductive thin film; 1105, an electron-emitting portion formed by the forming processing; and 1113, a thin film formed by the activation processing.

As the substrate 1101, various glass substrates of, e.g., quartz glass and soda-lime glass, various ceramic substrates of, e.g., alumina, or any of those substrates with an insulating layer formed thereon can be employed.

The device electrodes 1102 and 1103, provided in parallel to the substrate 1101 and opposing each other, comprise conductive material. For example, any material of metals such as Ni, Cr, Au, Mo, W, Pt, Ti, Cu, Pd and Ag, or alloys of these metals, otherwise metal oxides such as $In_2O_3$—$SnO_2$, or semiconductive material such as polysilicon, can be employed. The electrode is easily formed by the combination of a film-forming technique such as vacuum-evaporation and a patterning technique such as photolithography or etching. However, any other method (e.g., printing technique) may be employed.

The shape of the electrodes 1102 and 1103 is appropriately designed in accordance with an application object of the electron-emitting device. Generally, an interval L between electrodes is designed by selecting an appropriate value in a range from hundreds of angstroms to hundreds of micrometers. The most preferable range for a display apparatus is from several micrometers to tens of micrometers.

As for electrode thickness d, an appropriate value is in a range from hundreds of angstroms to several micrometers.

The conductive thin film 1104 comprises a fine particle film. The "fine particle film" is a film which contains a lot of fine particles (including masses of particles) as film-constituting members. In microscopic view, normally individual particles exist in the film at predetermined intervals, or adjacent to each other, or overlapped with each other.

One particle has a diameter within a range from several angstroms to thousands of angstroms. Preferably, the diameter is within a range from 10 angstroms to 200 angstroms. The thickness of the film is appropriately set in consideration of conditions such as the condition necessary for electrical connection to the device electrode 1102 or 1103, the condition for the forming processing to be described later, and the condition for setting electric resistance of the fine particle film itself to an appropriate value to be described later, etc.

Specifically, the thickness of the film is set in a range from several angstroms to thousands of angstroms, more preferably, 10 angstroms to 500 angstroms.

Materials used for forming the fine particle film are, e.g., metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge, and carbons. Any of appropriate material(s) is appropriately selected.

As described above, the conductive thin film 1104 is formed with a fine particle film, and sheet resistance of the film is set to reside within a range from $10^3$ to $10^7$ (Ω/sq).

As it is preferable that the conductive thin film 1104 is electrically connected to the device electrodes 1102 and 1103, they are arranged so as to overlap with each other at one portion. In FIG. 14B, the respective parts are overlapped in the order of, the substrate, the device electrodes, and the conductive thin film, from the bottom. This overlapping order may be, the substrate, the conductive thin film, and the device electrodes, from the bottom.

The electron-emitting portion 1105 is a fissured portion formed at a part of the conductive thin film 1104. The electron-emitting portion 1105 has a resistance characteristic higher than the peripheral conductive thin film. The fissure is formed by the forming processing to be described later on the conductive thin film 1104. In some cases, particles, having a diameter of several angstroms to hundreds of angstroms, are arranged within the fissured portion. As it is difficult to exactly illustrate the actual position and shape of the electron-emitting portion, FIGS. 14A and 14B show the fissured portion schematically.

The thin film 1113, which comprises carbon or carbon compound material, covers the electron-emitting portion 1105 and its peripheral portion. The thin film 1113 is formed by the activation processing to be described later after the forming processing.

The thin film 1113 is preferably graphite monocrystalline, graphite polycrystalline, amorphous carbon, or a mixture thereof, and its thickness is 500 angstroms or less, more preferably, 300 angstroms or less.

As it is difficult to exactly illustrate the actual position or shape of the thin film 1113, FIGS. 14A and 14B show the film schematically. FIG. 14A shows the device where a part of the thin film 1113 is removed.

The preferred basic structure of the SCE type electron-emitting device is as described above. In the embodiment, the device has the following constituents.

That is, the substrate 1101 comprises a soda-lime glass, and the device electrodes 1102 and 1103, an Ni thin film. The electrode thickness d is 1000 angstroms and the electrode interval L is 2 micrometers.

The main material of the fine particle film is Pd or Pdo. The thickness of the fine particle film is about 100 angstroms, and its width W is 100 micrometers.

Next, a method of manufacturing a preferred flat SCE type electron-emitting device will be described with reference to FIGS. 15A to 15E which are cross-sectional views showing the manufacturing processes of the SCE type electron-emitting device. Note that reference numerals are the same as those in FIGS. 12A and 12B.

Figure 15A:
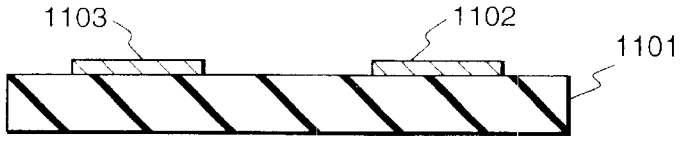
FIGS. 15A to 15E are views respectively showing the steps in manufacturing the flat surface-conduction emission type electron-emitting device.

(1) First, as shown in FIG. 15A, the device electrodes 1102 and 1103 are formed on the substrate 1101.

Upon formation of the electrodes 1102 and 1103, first, the substrate 1101 is fully washed with a detergent, pure water and an organic solvent, then, material of the device electrodes is deposited there. (As a depositing method, a vacuum film-forming technique such as evaporation and sputtering may be used.) Thereafter, patterning using a photolithography etching technique is performed on the deposited electrode material. Thus, the pair of device electrodes 1102 and 1103 are formed.

Figure 15B:
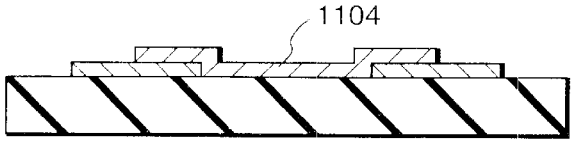

(2) Next, as shown in FIG. 15B, the conductive thin film 1104 is formed.

Upon formation of the conductive thin film 1104, first, an organic metal solvent is applied to the substrate in FIG. 15A, then the applied solvent is dried and sintered, thus forming a fine particle film. Thereafter, the fine particle film is patterned, in accordance with the photolithography etching method, into a predetermined shape. The organic metal solvent means a solvent of organic metal compound containing material of minute particles, used for forming the conductive thin film, as main component (i.e., Pd in this embodiment). In the embodiment, application of organic metal solvent is made by a dipping method, however, any other method such as a spinner method and spraying method may be employed.

As a film-forming method of the conductive thin film made with the minute particles, the application of organic metal solvent used in the embodiment can be replaced with any other method such as a vacuum evaporation method, a sputtering method or a chemical vapor-phase accumulation method.

Figure 15C:
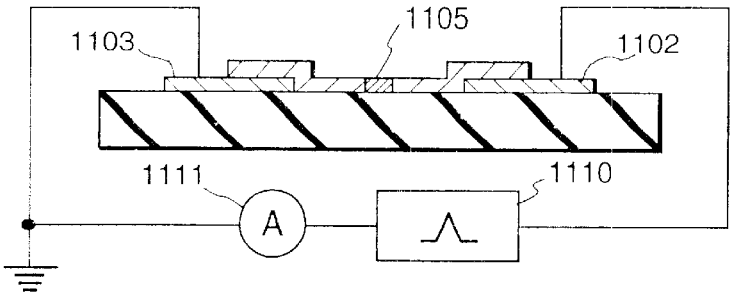

(3) Then, as shown in FIG. 15C, appropriate voltage is applied between the device electrodes 1102 and 1103, from a power source 1110 for the forming processing, then the forming processing is performed, thus forming the electron-emitting portion 1105.

The forming processing here is electric energization of a conductive thin film 1104 formed of a fine particle film, to appropriately destroy, deform, or deteriorate a part of the conductive thin film, thus changing the film to have a structure suitable for electron emission. In the conductive thin film, the portion changed for electron emission (i.e., electron-emitting portion 1105) has an appropriate fissure in the thin film. Comparing the thin film 1104 having the electron-emitting portion 1105 with the thin film before the forming processing, the electric resistance measured between the device electrodes 1102 and 1103 has greatly increased.

Figure 16:
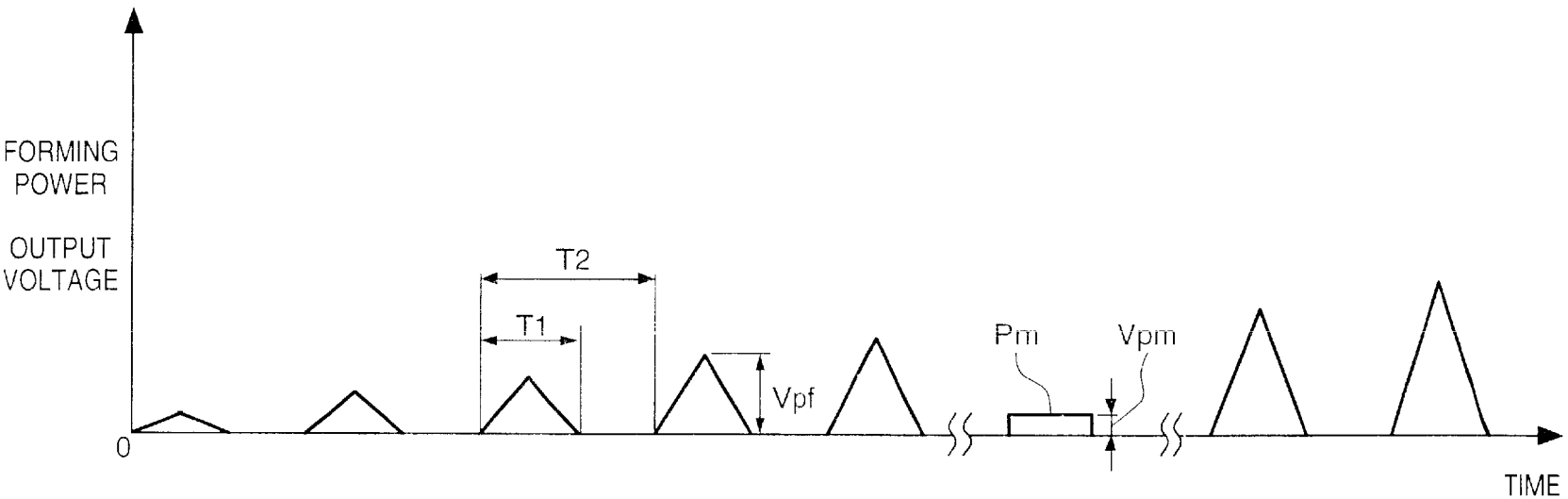
FIG. 16 is a graph showing the waveform of the applied voltage in forming processing.

The forming processing will be explained in detail with reference to FIG. 16 showing an example of waveform of appropriate voltage applied from the forming power source 1110. Preferably, in case of forming a conductive thin film of a fine particle film, a pulse-form voltage is employed. In this embodiment, a triangular-wave pulse having a pulse width T1 is continuously applied at a pulse interval of T2. Upon application, a wave peak value Vpf of the triangular-wave pulse is sequentially increased. Further, a monitor pulse Pm to monitor status of forming the electron-emitting portion 1105 is inserted between the triangular-wave pulses at appropriate intervals, and current that flows at the insertion is measured by a galvanometer 1111.

In this example, in $10^{-5}$ Torr vacuum atmosphere, the pulse width T1 is set to 1 msec; and the pulse interval T2, to 10 msec. The wave peak value Vpf is increased by 0.1 V, at each pulse. Each time the triangular-wave has been applied for five pulses, the monitor pulse Pm is inserted. To avoid adverse effect on the forming processing, a voltage Vpm of the monitor pulse is set to 0.1 V. When the electric resistance between the device electrodes 1102 and 1103 becomes $1\times10^{6}$ Ω, i.e., the current measured by the galvanometer 1111 upon application of monitor pulse becomes $1\times10^{-7}$ A or less, the electrification of the forming processing is terminated.

Note that the above processing method is preferable to the SCE type electron-emitting device of this embodiment. In case of changing the design of the SCE type electron-emitting device concerning, e.g., the material or thickness of the fine particle film, or the device electrode interval L, the conditions for electrification are preferably changed in accordance with the change of device design.

Figure 15D:
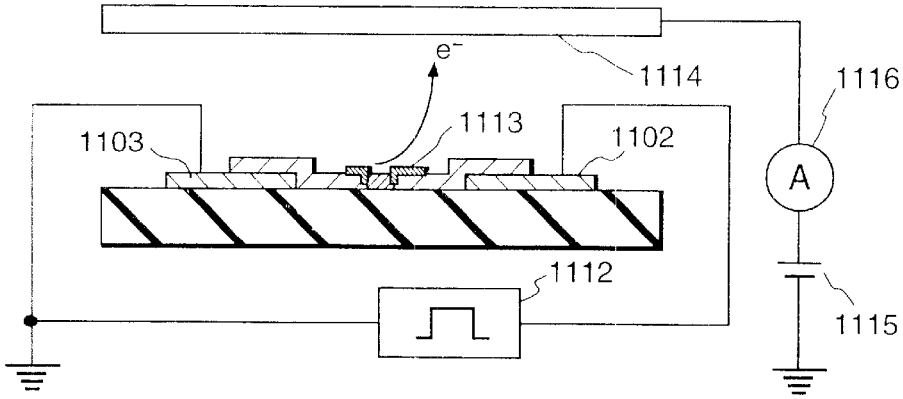

(4) Next, as shown in FIG. 15D, appropriate voltage is applied, from an activation power source 1112, between the device electrodes 1102 and 1103, and the activation processing is performed to improve electron-emitting characteristics.

The activation processing here is electrification of the electron-emitting portion 1105, formed by the forming processing, on appropriate condition(s), for depositing carbon or carbon compound around the electron-emitting portion 1105 (In FIG. 15D, the deposited material of carbon or carbon compound is shown as material 1113). Comparing the electron-emitting portion 1105 with that before the activation processing, the emission current at the same applied voltage has become, typically 100 times or greater.

The activation is made by periodically applying a voltage pulse in $10^{-4}$ or $10^{-5}$ Torr vacuum atmosphere, to accumulate carbon or carbon compound mainly derived from organic compound(s) existing in the vacuum atmosphere. The accumulated material 1113 is any of graphite monocrystalline, graphite polycrystalline, amorphous carbon or mixture thereof. The thickness of the accumulated material 1113 is 500 angstroms or less, more preferably, 300 angstroms or less.

Figure 17:
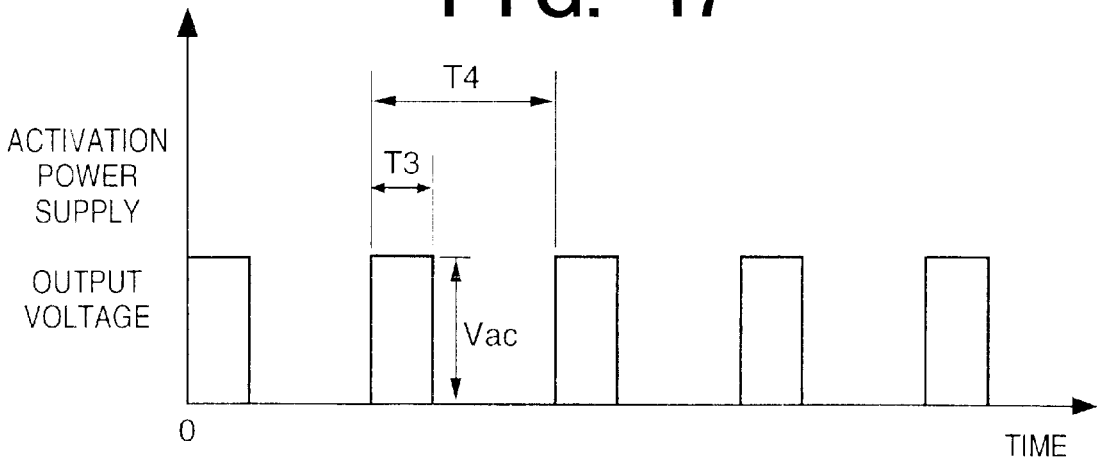
FIG. 17 is a graph showing the waveform of the applied voltage in activation processing.

The activation processing will be described in more detail with reference to FIG. 17 showing an example of a waveform of appropriate voltage applied from the activation power source 1112. In this example, a rectangular-wave voltage Vac is set to 14 V; a pulse width T3, to 1 msec; and a pulse interval T4, to 10 msec. Note that the above electrification conditions are preferable for the SCE type electron-emitting device of the embodiment. In a case where the design of the SCE type electron-emitting device is changed, the electrification conditions are preferably changed in accordance with the change of device design.

Figure 18:
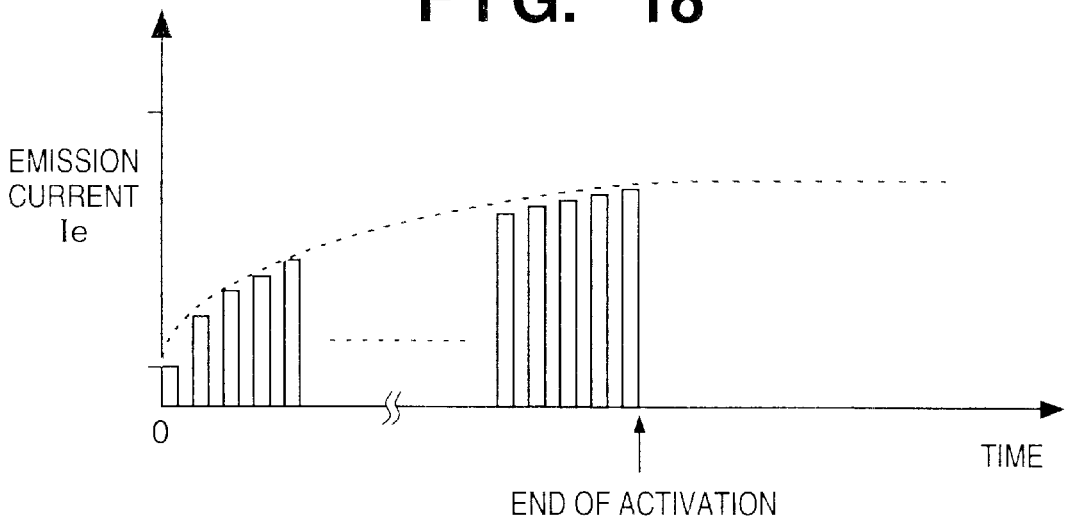
FIG. 18 is a graph showing a change in emission current Ie in activation processing.

In FIG. 15D, numeral 1114 denotes an anode electrode, connected to a direct-current (DC) high-voltage power source 1115 and a galvanometer 1116, for capturing emission current Ie emitted from the SCE type electron-emitting device (in a case where the substrate 1101 is incorporated into the display panel before the activation processing, the Al layer on the fluorescent surface of the display panel is used as the anode electrode 1114). While applying voltage from the activation power source 1112, the galvanometer 1116 measures the emission current Ie, thus monitoring the progress of activation processing, to control the operation of the activation power source 1112. FIG. 18 shows an example of the emission current Ie measured by the galvanometer 1116. In this example, as application of pulse voltage from the activation power source 1112 is started, the emission current Ie increases with lapse of time, gradually comes into saturation, and almost never increases then. At the substantial saturation point, the voltage application from the activation power source 1112 is stopped, then the activation processing is terminated.

Note that the above electrification conditions are preferable to the SCE type electron-emitting device of the embodiment. In case of changing the design of the SCE type electron-emitting device, the conditions are preferably changed in accordance with the change of device design.

Figure 15E:
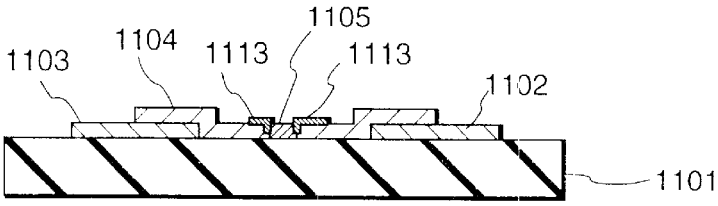

As described above, the flat SCE type electron-emitting device as shown in FIG. 15E is manufactured.

<Step SCE Type Electron-Emitting Device>

Next, another typical structure of the SCE type electron-emitting device where an electron-emitting portion or its peripheral portion is formed of a fine particle film, i.e., a stepped SCE type electron-emitting device will be described.

Figure 19:
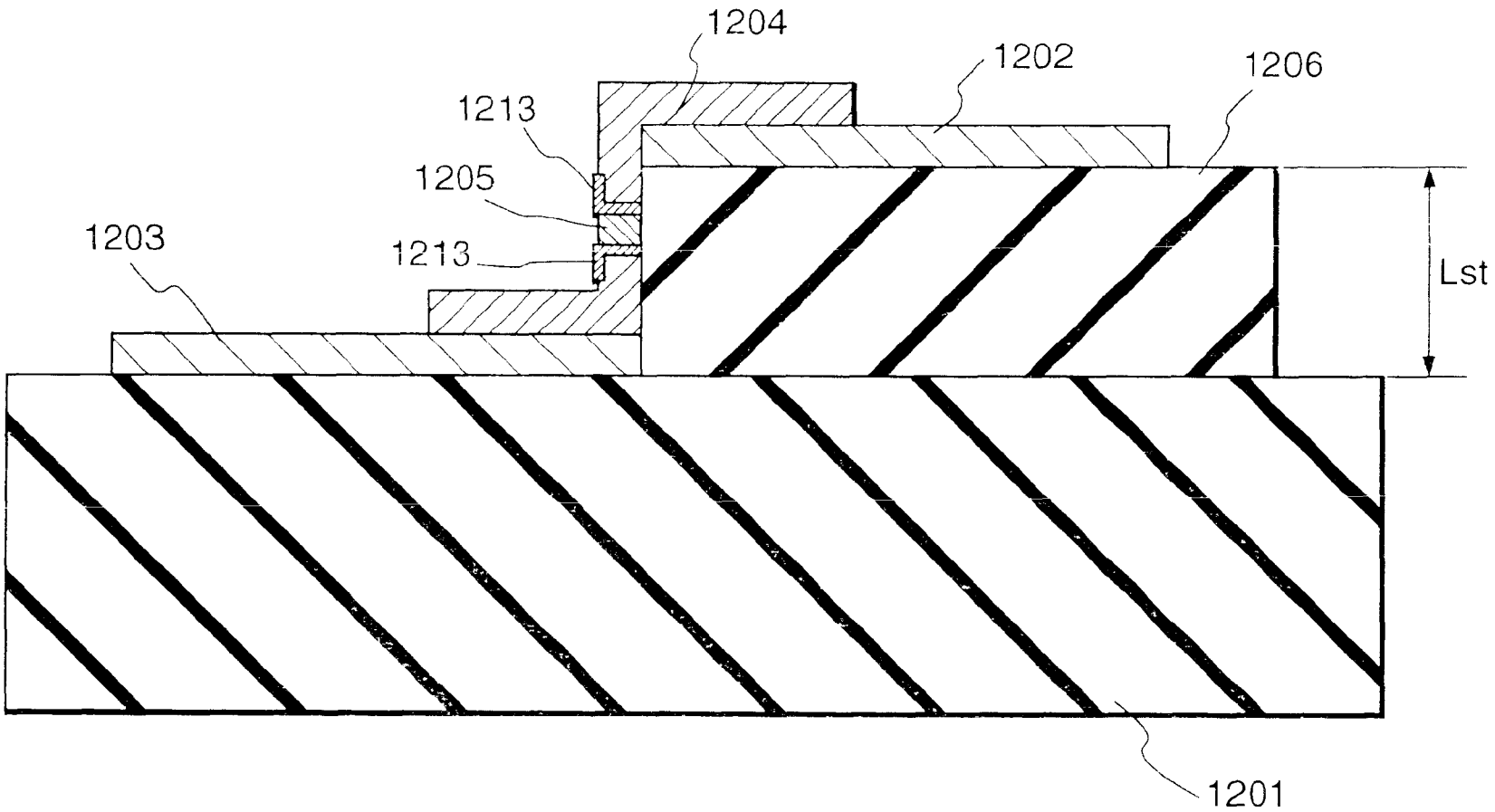
FIG. 19 is a cross-sectional view of a step surface-conduction emission type electron-emitting device used in the embodiment.

FIG. 19 is across-sectional view schematically showing the basic construction of the step SCE type electron-emitting device. In FIG. 19, numeral 1201 denotes a substrate; 1202 and 1203, device electrodes; 1206, a step-forming member for making a height difference between the electrodes 1202 and 1203; 1204, a conductive thin film using a fine particle film; 1205, an electron-emitting portion formed by the forming processing; and 1213, a thin film formed by the activation processing.

A difference between the step device structure and the above-described flat device structure is that one of the device electrodes (1202 in this example) is provided on the step-forming member 1206 and the conductive thin film 1204 covers the side surface of the step-forming member 1206. The device interval L in FIGS. 14A and 14B is set in this structure as a height difference Lst corresponding to the height of the step-forming member 1206. Note that the substrate 1201, the device electrodes 1202 and 1203, the conductive thin film using the fine particle film can comprise the materials given in the explanation of the flat SCE type electron-emitting device. Further, the step-forming member 1206 comprises electrically insulating material such as $SiO_2$.

Next, a method of manufacturing the stepped SCE type electron-emitting device will be described with reference FIGS. 20A to 20F which are cross-sectional views showing the manufacturing processes. In these figures, reference numerals of the respective parts are the same as those in FIG. 19.

Figure 20A:
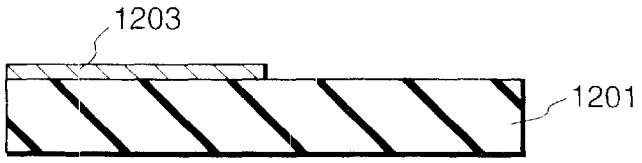
FIGS. 20A to 20F are views showing the steps in manufacturing the step surface-conduction emission type electron-emitting device.

(1) First, as shown in FIG. 20A, the device electrode 1203 is formed on the substrate 1201.

Figure 20B:
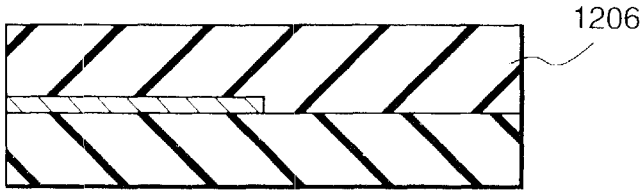

(2) Next, as shown in FIG. 20B, an insulating layer for forming the step-forming member 1206 is deposited. The insulating layer may be formed by accumulating, e.g., $SiO_2$ by a sputtering method, however, the insulating layer may be formed by a film-forming method such as a vacuum evaporation method or a printing method.

Figure 20C:
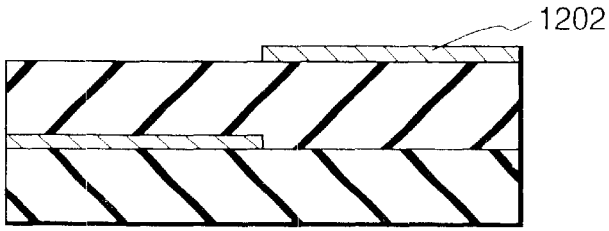

(3) Next, as shown in FIG. 20C, the device electrode 1202 is formed on the insulating layer.

Figure 20D:
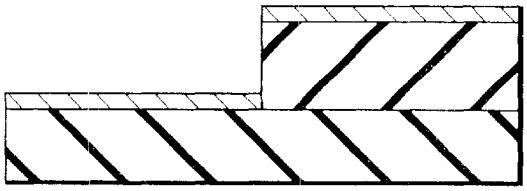

(4) Next, as shown in FIG. 20D, a part of the insulating layer is removed by using, e.g., an etching method, to expose the device electrode 1203.

Figure 20E:
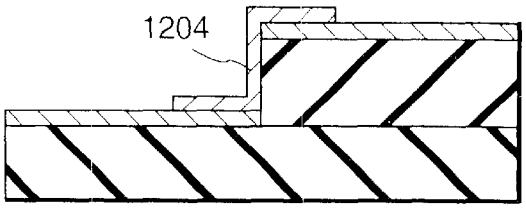

(5) Next, as shown in FIG. 20E, the conductive thin film 1204 using the fine particle film is formed. Upon formation, similar to the above-described flat device structure, a film-forming technique such as an applying method is used.

(6) Next, similar to the flat device structure, the forming processing is performed to form the electron-emitting portion 1205. (The forming processing similar to that explained using FIG. 15C may be performed).

(7) Next, similar to the flat device structure, the activation processing is performed to deposit carbon or carbon compound around the electron-emitting portion. (Activation processing similar to that explained using FIG. 15D may be performed).

Figure 20F:
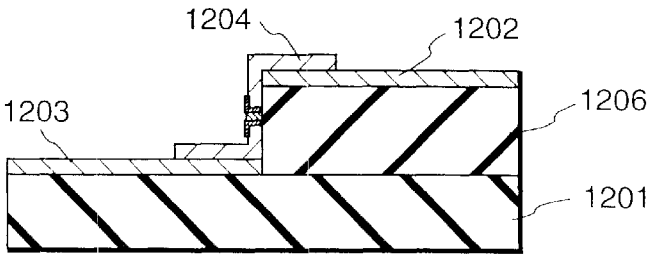

As described above, the stepped SCE type electron-emitting device shown in FIG. 20F is manufactured.

<Characteristic of SCE Type Electron-Emitting Device Used in Display Apparatus>

The structure and manufacturing method of the flat SCE type electron-emitting device and those of the stepped SCE type electron-emitting device are as described above. Next, the characteristic of the electron-emitting device used in the display apparatus will be described below.

Figure 21:
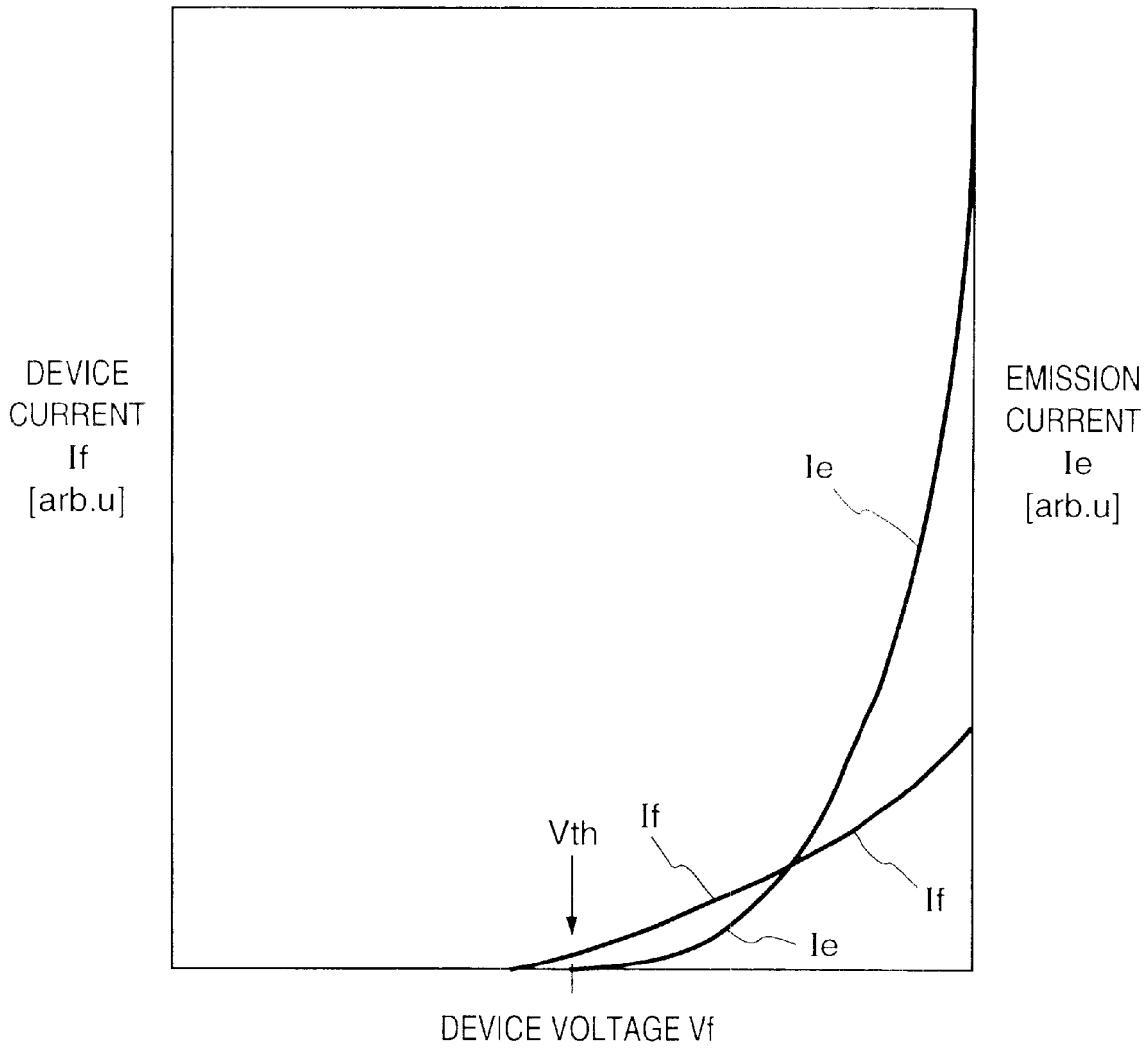
FIG. 21 is a graph showing typical characteristics of the surface-conduction emission type electron-emitting device used in the embodiment.

FIG. 21 shows a typical example of (emission current Ie) to (device voltage (i.e., voltage to be applied to the device) Vf) characteristic and (device current If) to (device application voltage Vf) characteristic of the device used in the display apparatus. Note that compared with the device current If, the emission current Ie is very small, therefore it is difficult to illustrate the emission current Ie by the same measure of that for the device current If. In addition, these characteristics change due to change of designing parameters such as the size or shape of the device. For these reasons, two lines in the graph of FIG. 21 are respectively given in arbitrary units.

Regarding the emission current Ie, the device used in the display apparatus has three characteristics as follows:

First, when voltage of a predetermined level (referred to as "threshold voltage Vth") or greater is applied to the device, the emission current Ie drastically increases, however, with voltage lower than the threshold voltage Vth, almost no emission current Ie is detected.

That is, regarding the emission current Ie, the device has a nonlinear characteristic based on the clear threshold voltage Vth.

Second, the emission current Ie changes in dependence upon the device application voltage Vf. Accordingly, the emission current Ie can be controlled by changing the device voltage Vf.

Third, the emission current Ie is output quickly in response to application of the device voltage Vf. Accordingly, an electrical charge amount of electrons to be emitted from the device can be controlled by changing the period of application of the device voltage Vf.

The SCE type electron-emitting device with the above three characteristics is preferably applied to the display apparatus. For example, in a display apparatus having a large number of devices provided corresponding to the number of pixels of a display screen, if the first characteristic is utilized, display by sequential scanning of the display screen is possible. This means that the threshold voltage Vth or greater is appropriately applied to a selected device, while voltage lower than the threshold voltage Vth is applied to an unselected device. In this manner, sequentially changing the driven devices enables display by sequential scanning of the display screen.

Further, emission luminance can be controlled by utilizing the second or third characteristic, which enables multi-gradation display.

<Structure of Electron Source Substrate>

Next, the structure of a multi electron-beam source where the above SCE type electron-emitting devices are arranged with the simple-matrix wiring will be described below.

Figure 22:
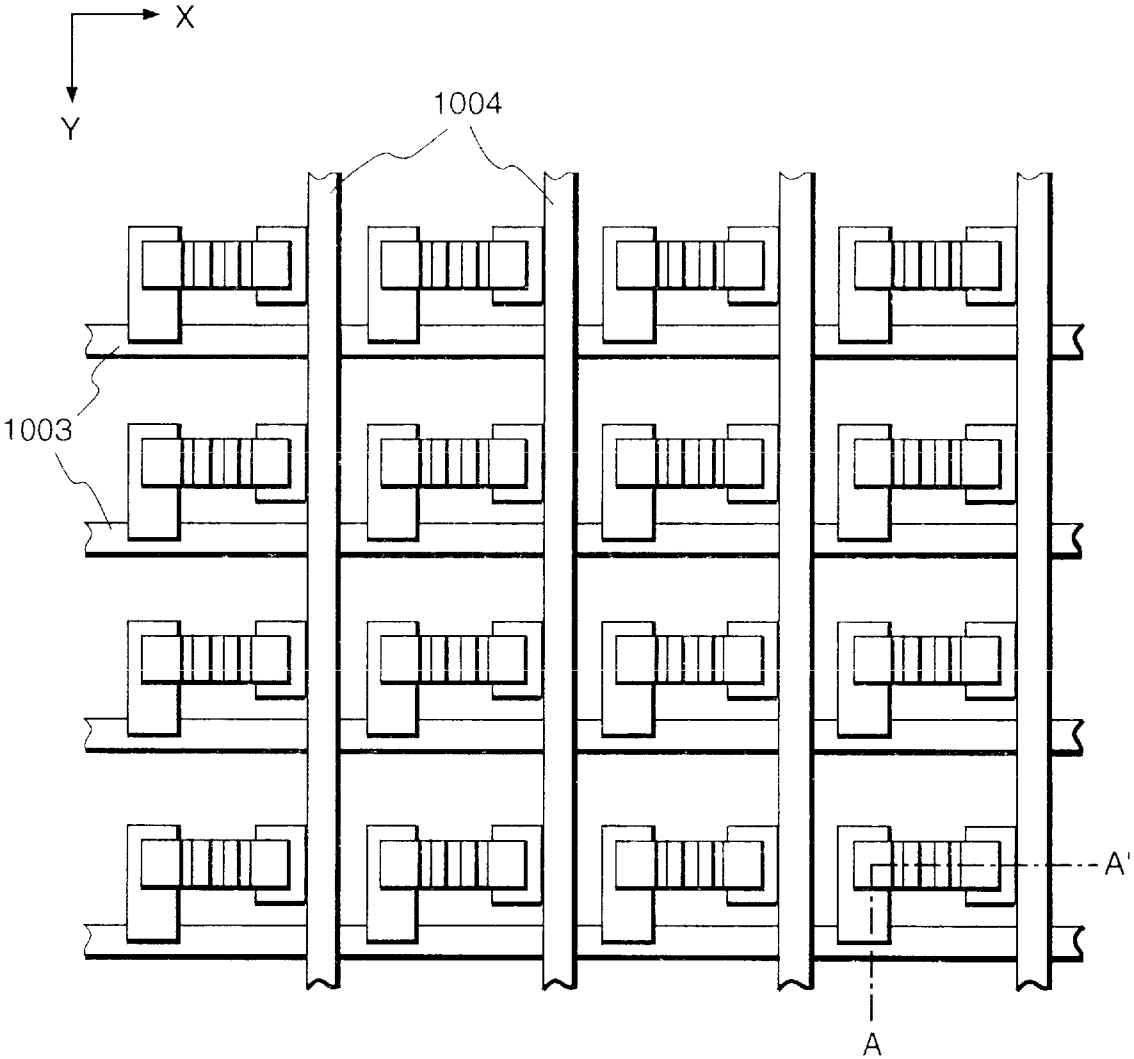
FIG. 22 is a plan view of an electron source substrate used in the embodiment.

FIG. 22 is a plan view of the electron source substrate 1001 on the E1 side that is used in the display panel in FIG. 14. There are SCE type electron-emitting devices similar to those shown in FIGS. 14A and 14B on the substrate. These devices are arranged in a simple matrix with the row-direction wiring 1003 and the column-direction wiring 1004. At an intersection of the wirings 1003 and 1004, an insulating layer (not shown) is formed between the wires, to maintain electrical insulation.

Figure 23:
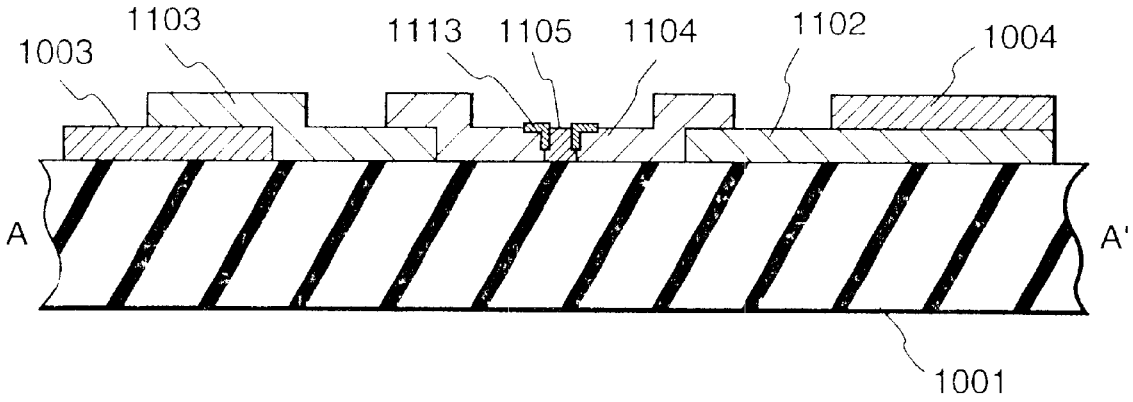
FIG. 23 is a partial cross-sectional view of the electron source substrate used in the embodiment.

FIG. 23 shows a cross-section cut out along the line A–A' in FIG. 22.

Note that this type electron source substrate E1 is manufactured by forming the row- and column-direction wirings 1003 and 1004, the insulating layers (not shown) at wires' intersections, the device electrodes and conductive thin films on the substrate 1001, then supplying electricity to the respective devices via the row- and column-direction wirings 1003 and 1004, thus performing the forming processing and the activation processing.

<Method of Driving Display Panel>

Figure 24:
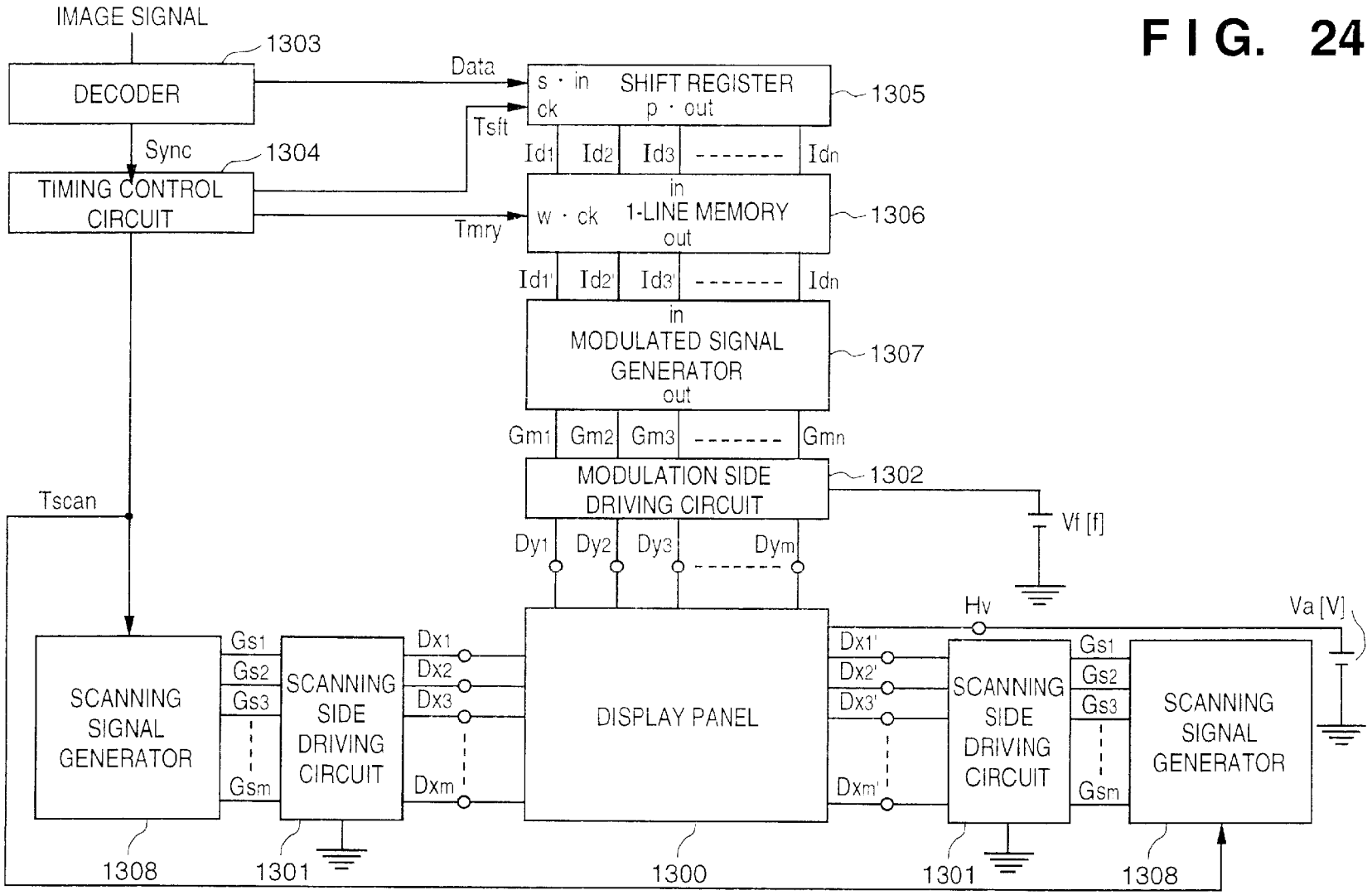
FIG. 24 is a block diagram of a driving circuit for the display panel of the embodiment.
Figure 25:
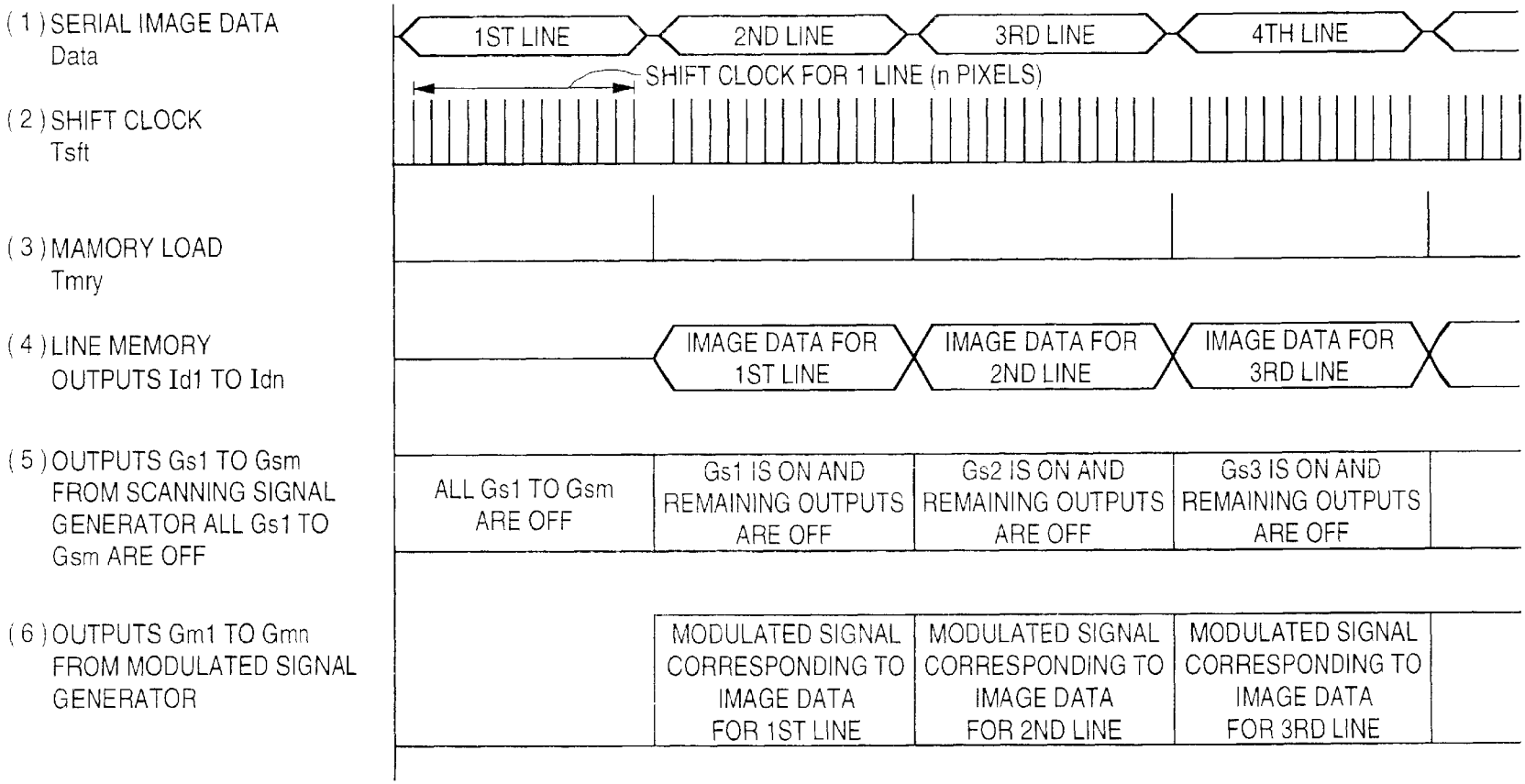
FIG. 25 is a timing chart showing the operation procedure of the driving circuit of the embodiment.

A method of displaying an image on the display panel in FIG. 12 will be described with reference to FIGS. 24 and 25. FIG. 24 is a block diagram of electrical circuits, and FIG. 25 is a timing chart showing the operations of the electrical circuits.

Referring to FIG. 24, numeral 1300 denotes a display panel shown in FIG. 12; 1301, scanning driving circuits; 1302, a modulation driving circuit; 1303, a decoder; 1304, a timing control circuit; 1305, a shift register; 1306, a 1-line memory; 1307, a modulated signal generator; and 1308, scanning signal generators. Symbols Va and Vf are power sources. The operations of the respective parts will be sequentially explained below.

In general, an image signal (e.g., a television signal) externally input to the decoder 1303 is input in a time series manner.

The externally supplied image signal is divided by the decoder 1303 into a synchronizing signal Sync and image data Data, which are respectively output to the timing control circuit 1304 and the shift register 1305. (More specifically, the synchronizing signal Sync is made up of a horizontal synchronizing signal serving as a synchronizing signal for one line of an image, and a vertical synchronizing signal serving as a synchronizing signal for one frame of the image, but the two signals are collectively called the synchronizing signal Sync for this sake of descriptive simplicity. The image data Data is made up of three R, G, B primary color components, but these components are collectively called the image data Data for this sake of descriptive simplicity.)

On the basis of the synchronizing signal Sync, the timing control circuit 1304 generates various timing control signals for matching the operations of the respective parts of the display apparatus.

The timing control circuit 1304 outputs, to the shift register 1305, a shift clock Tsft for sampling image data corresponding to one line (=n pixels) of the display panel and serial/parallel-converting the data. The image data Data and the shift clock Tsft are shown in (1) and (2) of the timing chart in FIG. 25.

The serial/parallel-converted data (Id1 to Idn) corresponding to one line of the image are stored in the line memory 1306 on the basis of a memory load timing control signal Tmry output from the timing control circuit 1304. The memory load timing control signal Tmry and output signals (I'd1 to I'dn) from the line memory 1306 are shown in (3) and (4) of the timing chart in FIG. 25.

The modulated signal generator 1307 generates modulated signals Gm1 to Gmn based on the output signals (I'd1 to I'dn) from the line memory 1306. In this embodiment, a pulse width modulation scheme for modulating the width of a pulse in accordance with image data is employed for the modulated signal generator 1307.

The timings of the modulated signals Gm1 to Gmn are shown in (6) of FIG. 25.

The modulation driving circuit 1302 generates a pulse signal having a width controlled in accordance with the modulated signals Gm1 to Gmn at a voltage Vf [V]. This pulse signal is supplied to the column-direction wiring of an electron source substrate via feeding terminals Dy1 to Dyn of the display panel. (In this embodiment, the voltage Vf is set to 20 V.)

The timing control circuit 1304 generates a control signal Tscan for scanning a multi electron-beam source inside the display panel 1300, and outputs it to the scanning signal generators 1308. In this embodiment, the scanning signal generator 1308 and the scanning driving circuit 1301 are arranged for each of two electron source substrates inside the display panel, and operate at the same timing.

The scanning signal generator 1308 generates scanning signals Gs1 to Gsm on the basis of the control signal Tscan. The contents of the scanning signals Gs1 to Gsm are shown in (5) of FIG. 25. In correspondence with an "ON" scanning signal, the scanning side driving circuit 1301 sets a feeding terminal to the ground level, i.e., 0 V. That is, 0-V scanning pulses are applied to the column-direction wiring of the electron source substrates via feeding terminals Dx1 to Dxm and Dx1' to Dxm' of the display panel.

The power source Va outputs a DC voltage of 5 kV, which is applied to fluorescent substances within the display panel 1300 via a feeding terminal Hv.

The method of driving the display panel 1300 has been described.

<Second Embodiment>

The second embodiment using the second structure of the present invention will be described. Respective parts will be described in detail with reference to FIG. 6.

As an electron-emitting device 1, a field emission type electron-emitting device was used. The size of the respective parts were set as follows.

Px=PAx=PBx=0.5 mm

Lh=40 mm

Ldx=127 mm

Ldz=38 mm

Ls=4.5 mm

The voltage Va to be applied to a fluorescent substance 13 and the voltage Vdef to be applied to a deflection electrode were set to Va=5 kV Vdef=840 V <Multi-Functional Display Apparatus>

An example of applying the above embodiment to a multi-functional display apparatus will be explained.

Figure 26:
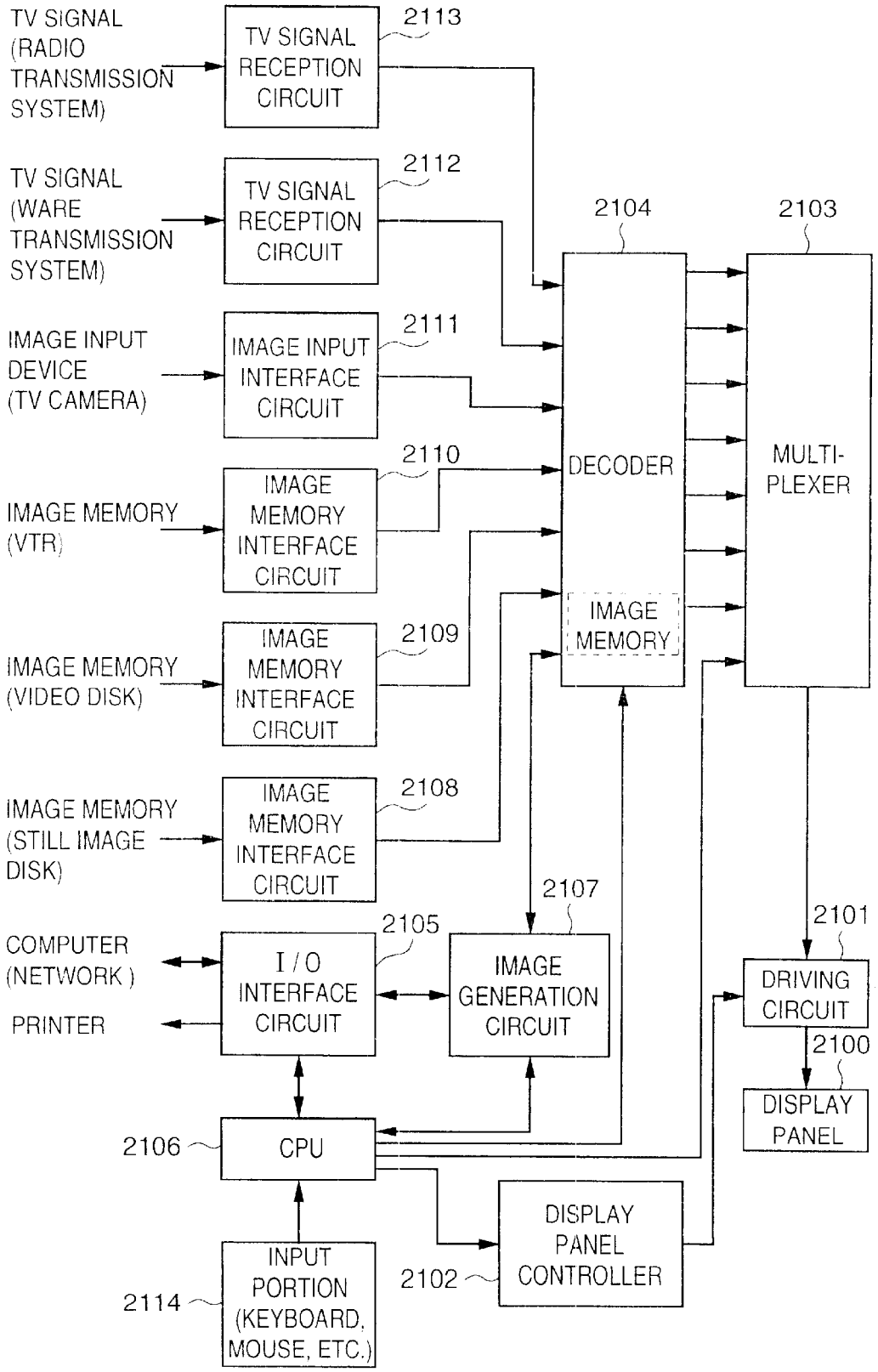
FIG. 26 is a block diagram showing the arrangement of an apparatus in which the present invention is applied as a display panel using the surface-conduction emission type electron-emitting device as an electron beam source.

FIG. 26 is a block diagram of a multi-functional display apparatus capable of displaying image information provided from various image information sources such as television broadcasting on a display panel using, as an electron beam source, an SCE type electron-emitting device manufactured by the above-described method.

Referring to FIG. 26, numeral 2100 denotes a display panel; 2101, a driving circuit for the display panel; 2102, a display controller; 2103, a multiplexer; 2104, a decoder; 2105, an I/O interface circuit; 2106, a CPU; 2107, an image generation circuit; 2108, 2109, and 2110, image memory interface circuits; 2111, an image input interface circuit; 2112 and 2113, TV signal reception circuits; and 2114, an input portion.

(In this display apparatus, upon reception of a signal containing both video information and audio information such as a television signal, the video information is displayed while the audio information is reproduced. A description of a circuit or a speaker for reception, division, reproduction, processing, storage, or the like of the audio information, which is not directly related to the features of the present invention, will be omitted.)

The functions of the respective parts will be explained in accordance with the flow of an image signal.

The TV signal reception circuit 2113 receives a TV image signal transmitted using a radio transmission system such as radio waves or spatial optical communication. The scheme of the TV signal to be received is not particularly limited, and is the NTSC scheme, the PAL scheme, the SECAM scheme, or the like. A more preferable signal source to take advantage of the display panel realizing a large area and a large number of pixels is a TV signal (e.g., a so-called high-quality TV of the MUSE scheme or the like) made up of a larger number of scanning lines than that of the TV signal of the above scheme. The TV signal received by the TV signal reception circuit 2113 is output to the decoder 2104.

The TV signal reception circuit 2112 receives a TV image signal transmitted using a wire transmission system such as a coaxial cable or an optical fiber. The scheme of the TV signal to be received is not particularly limited, as in the TV signal reception circuit 2113. The TV signal received by the circuit 2112 is also output to the decoder 2104.

The image input interface circuit 2111 receives an image signal supplied from an image input device such as a TV camera or an image read scanner, and outputs it to the decoder 2104.

The image memory interface circuit 2110 receives an image signal stored in a video tape recorder (to be briefly referred to as a VTR hereinafter), and outputs it to the decoder 2104.

The image memory interface circuit 2109 receives an image signal stored in a video disk, and outputs it to the decoder 2104.

The image memory interface circuit 2108 receives an image signal from a device storing still image data such as a so-called still image disk, and outputs the received still image data to the decoder 2104.

The I/O interface circuit 2105 connects the display apparatus to an external computer, a computer network, or an output device such as a printer. The I/O interface circuit 2105 can perform input/output of image data, character data, and graphic information, and in some cases input/output of a control signal and numerical data between the CPU 2106 of the display apparatus and an external device.

The image generation circuit 2107 generates display image data on the basis of image data or character/graphic information externally input via the I/O interface circuit 2105, or image data or character/graphic information output from the CPU 2106. This circuit 2107 incorporates circuits necessary to generate images such as a programmable memory for storing image data and character/graphic information, a read-only memory storing image patterns corresponding to character codes, and a processor for performing image processing.

Display image data generated by the circuit 2107 is output to the decoder 2104. In some cases, display image data can also be input/output from/to an external computer network or a printer via the I/O interface circuit 2105.

The CPU 2106 mainly performs control of the operation of this display apparatus, and operations about generation, selection, and editing of display images.

For example, the CPU 2106 outputs a control signal to the multiplexer 2103 to properly select or combine image signals to be displayed on the display panel. At this time, the CPU 2106 generates a control signal to the display panel controller 2102 in accordance with the image signals to be displayed, and appropriately controls the operation of the display apparatus in terms of the screen display frequency, the scanning method (e.g., interlaced or non-interlaced scanning), the number of scanning lines for one frame, and the like.

The CPU 2106 directly outputs image data or character/graphic information to the image generation circuit 2107. In addition, the CPU 2106 accesses an external computer or a memory via the I/O interface circuit 2105 to input image data or character/graphic information.

The CPU 2106 may also be concerned with operations for other purposes. For example, the CPU 2106 can be directly concerned with the function of generating and processing information, like a personal computer or a wordprocessor.

Further, the CPU 2106 may be connected to an external computer network via the I/O interface circuit 2105 to perform an operation such as numerical calculation in cooperation with an external device.

The input portion 2114 allows the user to input an instruction, a program, or data to the CPU 2106. As the input portion 2114, various input devices such as a joystick, a bar code reader, and a speech recognition device are available in addition to a keyboard and a mouse.

The decoder 2104 inversely converts various image signals input from the circuits 2107 to 2113 into three primary color signals, or a luminance signal and I and Q signals. As is indicated by the dotted line in FIG. 26, the decoder 2104 desirably incorporates an image memory in order to process a television signal of the MUSE scheme or the like which requires an image memory in inverse conversion. This image memory advantageously facilitates display of a still image, or image processing and editing such as thinning, interpolation, enlargement, reduction, and synthesis of images in cooperation with the image generation circuit 2107 and the CPU 2106.

The multiplexer 2103 appropriately selects a display image on the basis of a control signal input from the CPU 2106. More specifically, the multiplexer 2103 selects a desired one of the inversely converted image signals input from the decoder 2104, and outputs the selected image signal to the driving circuit 2101. In this case, by selectively switching the image signals switched within a 1-frame display time, different images can be displayed in a plurality of areas of one frame as in a so-called multiwindow television.

The display panel controller 2102 controls the operation of the driving circuit 2101 on the basis of a control signal input from the CPU 2106.

As for the basic operation of the display panel, the display panel controller 2102 outputs, e.g., a signal for controlling the operation sequence of a driving power source (not shown) of the display panel to the driving circuit 2101.

As for the method of driving the display panel, the display panel controller 2102 outputs, e.g., a signal for controlling the screen display frequency or the scanning method (e.g., interlaced or non-interlaced scanning) to the driving circuit 2101.

In some cases, the display panel controller 2102 outputs a control signal associated with adjustment of the image quality such as the brightness, contrast, color tone, or sharpness to the driving circuits 2101.

The driving circuit 2101 generates a driving signal to be supplied to the display panel 2100, and operates based on an image signal input from the multiplexer 2103 and a control signal input from the display panel controller 2102.

The functions of the respective parts have been described. The arrangement of the display apparatus shown in FIG. 26 makes it possible to display image information input from various image information sources on the display panel 2100.

More specifically, various image signals such as television broadcasting image signals are inversely converted by the decoder 2104, a desired one of the inversely converted signals is selected by the multiplexer 2103, and the selected signal is supplied to the driving circuit 2101. On the other hand, the display controller 2102 generates a control signal for controlling the operation of the driving circuit 2101 in accordance with an image signal to be displayed. The driving circuit 2101 applies a driving signal to the display panel 2100 on the basis of the image signal and the control signal.

With this operation, the image is displayed on the display panel 2100. A series of operations are systematically controlled by the CPU 2106.

In this display apparatus, the image memory incorporated in the decoder 2104, the image generation circuit 2107 and the CPU 2106 can cooperate with each other to simply display the selected ones of the plurality of pieces of image information and to perform image processing such as enlargement, reduction, rotation, movement, edge emphasis, thinning, interpolation, color conversion, and image aspect ratio conversion, and image editing such as synthesis, erasure, connection, exchange, and pasting for the image information to be displayed. Although not described in this embodiment, an audio circuit for processing and editing audio information may be arranged, similar to the image processing and the image editing.

The display apparatus can therefore have the functions of a display device for television broadcasting, a terminal device for video conferences, an image editing device handling a still image and a dynamic image, a terminal device for computers, an office terminal device such as a wordprocessor, a game device, and the like. This display apparatus is useful for industrial and business purposes, and its application range is very wide.

FIG. 26 merely shows an example of the arrangement of the display apparatus using the display panel having the SCE type electron-emitting device as an electron beam source. The present invention is not limited to this, as a matter of course. For example, among the constituent members in FIG. 26, a circuit associated with a function unnecessary for the application purpose can be eliminated from the display apparatus. To the contrary, another constituent member can be added to the display apparatus in accordance with the application purpose. For example, when this display apparatus is used as a television telephone set, transmission and reception circuits including a television camera, an audio microphone, a light, and a modem are preferably added as constituent members.

In this display apparatus, since particularly the display panel using the SCE type electron-emitting device as an electron beam source can be easily made thin, the width of the whole display apparatus can be decreased. In addition to this, the display panel using the SCE type electron-emitting device as an electron beam source is easily increased in screen size and has a high brightness and an excellent view angle characteristic. This display apparatus can therefore display an impressive image with reality and high visibility.

<Other Embodiments>

The present invention can be applied to any cold cathode electron-emitting device except for an SCE type electron-emitting device. As a concrete example, there is a lateral field emission type electron-emitting device in which a pair of electrodes facing each other are formed along a substrate surface serving as an electron source, like the one disclosed in Japanese Patent Laid-Open No. 63-274047 filed by the present applicant.

The present invention is also applicable to an image forming apparatus using an electron source other than a simple matrix type electron source. For example, a support member like the one described above is used in an image forming apparatus for selecting SCE type electron-emitting devices using control electrodes, like the one disclosed in Japanese Patent Laid-Open No. 2-257551 filed by the present applicant.

According to the concepts of the present invention, the present invention is not limited to an image forming apparatus suitable for display. The above-mentioned image forming apparatus can also be used as a light-emitting source instead of a light-emitting diode for an optical printer made up of a photosensitive drum, the light-emitting diode, and the like. In this case, by properly selecting m row-direction wirings and n column-direction wirings, the image forming apparatus can be applied as not only a line-shaped light-emitting source but also a two-dimensional light-emitting source.

As described above, according to the embodiments of the present invention, in realizing a large-screen display apparatus including a spacer as a structure, an electron beam is deflected toward the spacer by a proper distance. This can prevent generation of a light emission disabled region which is a conventional problem. A large-screen display apparatus provided by the present invention has high image quality, so that its utility value is very high for business and industrial purposes.

As has been described above, according to the present invention, generation of an image formation disabled region can be suppressed, and a high-quality image can be formed with a simple structure.

What is claimed is:

1. An image-forming apparatus comprising:

an electron source on which a plurality of electron-emitting devices are arranged;

an image-forming member on which an image is formed by irradiation of electrons emitted by said electron-emitting devices;

a structure arranged between said electron source and said image-forming member to maintain an interval between said electron source and said image-forming member; and deflection means for deflecting each of electrons emitted by two adjacent electron-emitting devices, the structure being positioned between the two adjacent electron-emitting devices, toward the structure while the electrons are traveling from said electron-emitting devices to said image-forming member, wherein each of said electron-emitting devices comprises a negative electrode, an electron-emitting portion, and a positive electrode which are arranged on a substrate surface for arranging said electron-emitting device.

2. The apparatus according to claim 1, wherein said plurality of electron-emitting devices are arranged substantially linearly.

3. The apparatus according to claim 2, wherein said plurality of electron-emitting devices arranged substantially linearly are arranged to have an interval between two electron-emitting devices adjacent to each other via said structure larger than an interval between two electron-emitting devices adjacent to each other without mediacy of said structure.

4. The apparatus according to claim 1, wherein said positive electrode is arranged nearer said structure than said negative electrode.

5. The apparatus according to claim 4, wherein said electron-emitting device is a surface-conduction emission electron-emitting device.

6. The apparatus according to claim 4, wherein said electron-emitting device is a lateral field emission electron-emitting device.

7. The apparatus according to claim 1, wherein said deflection means is a deflection electrode arranged between said structure and a path through which electrons emitted by said electron-emitting devices reach irradiation positions of said image-forming member.

8. The apparatus according to claim 1, wherein said electron-emitting devices are field emission electron-emitting devices.

9. The apparatus according to claim 1, wherein said electron-emitting devices are surface-conduction emission electron-emitting devices.

10. The apparatus according to claim 1, wherein said electron-emitting devices are MIM electron-emitting devices.

11. The apparatus according to claim 1, wherein said plurality of electron-emitting devices are wired in a matrix by row-direction wiring and column-direction wiring.

12. The apparatus according to claim 1, wherein, when electrons emitted by said plurality of electron-emitting devices reach said image-forming member to form pixels, an interval between pixels formed by electrons emitted by two electron-emitting devices adjacent to each other via said structure is almost equal to an interval between pixels formed by electrons emitted by two electron-emitting devices adjacent to each other without mediacy of said structure.

13. An image-forming apparatus comprising:

an electron source having a plurality of electron-emitting devices arranged substantially linearly;

an image-forming member on which an image is formed by irradiation of electrons emitted by said electron-emitting devices; and a structure arranged between said electron source and said image-forming member to maintain an interval between said electron source and said image-forming member, wherein an interval between two electron-emitting devices adjacent to each other via said structure is larger than an interval between two electron-emitting devices adjacent to each other without mediacy of said structure, and electrons emitted by said electron-emitting devices are deflected toward said support structure while the electrons are traveling from said electron-emitting devices to said image-forming member, and wherein each of said electron-emitting devices comprises a negative electrode, an electron-emitting portion, and a positive electrode which are arranged on a substrate surface for arranging said electron-emitting device.

14. The apparatus according to claim 13, wherein, when electrons emitted by said plurality of electron-emitting devices reach said image-forming member to form pixels, the interval between said two electron-emitting devices adjacent to each other via said structure, and the interval between said two electron-emitting devices adjacent to each other without mediacy of said structure, are set to have an interval between pixels formed by electrons emitted by said two electron-emitting devices adjacent to each other via said structure substantially equal to an interval between pixels formed by electrons emitted by said two electron-emitting devices adjacent to each other without mediacy of said structure.

15. An image-forming apparatus comprising:

an electron source on which a plurality of electron-emitting devices are arranged;

an image-forming member on which an image is formed by irradiation of electrons emitted by said electron-emitting devices;

a structure arranged between said electron source and said image-forming member to maintain an interval between said electron source and said image-forming member; and a deflection electrode for deflecting electrons emitted by the electron-emitting devices toward the structure while the electrons are traveling from said electron-emitting devices to said image-forming member, wherein said deflection electrode is formed on the structure, and an interval between two electron-emitting devices adjacent to each other via said structure is larger than an interval between two electron-emitting devices adjacent to each other without mediacy of said structure.

16. The apparatus according to claim 15, wherein said deflection electrode is formed on a lateral surface of the structure.

17. The apparatus according to claim 15, wherein said deflection electrode is formed on a lateral surface of the structure so as to deflect electrons at an intermediate region between the image-forming member and the electron source.

18. The apparatus according to claim 15, further comprising another electrode opposed to said deflection electrode.

19. The apparatus according to claim 18, wherein said other electrode is electrically connected to ground.

20. The apparatus according to claim 15, wherein a voltage is applied to said deflection electrode.

21. The apparatus according to claim 15, wherein a potential distribution around an electron-emitting portion of the electron-emitting devices is asymmetrical about a normal line of a plane defined by a substrate of the electron source that passes through the election-emitting portion in a driven state.

* * * * *

UNITED STATES PATENT AND TRADEMARK OFFICE

CERTIFICATE OF CORRECTION

PATENT NO. : 6,472,813 B2
DATED : October 29, 2002
INVENTOR(S) : Hideaki Mitsutake et al.

It is certified that error appears in the above-identified patent and that said Letters Patent is hereby corrected as shown below:

Title page,
Item [56], U.S. PATENT DOCUMENTS, "5,734,883 A 3/1999" should read -- 5,734,224 A 3/1999 --.

Drawings,
FIGURE 25, Sheet 24, "(3) MAMORY LOAD" should read -- (3) MEMORY LOAD --.

Column 1,
Line 34, "9,317" should read -- 9, 317 --.

Column 2,
Line 7, "Dykeand" should read -- Dyke and --.
Line 42, "micro patterned." should read -- micropatterned. --.
Line 67, "an surface." should read -- a surface. --.

Column 6,
Line 56, "se con d" should read -- second --.

Column 7,
Line 4, "in e the" should read -- in the --.

Column 8,
Line 7, "the z" should read -- the Z --.

Column 12,
Line 56, "electric" should read -- electron --.

Column 16,
Line 8, "across-sectional" should read -- a cross-sectional --.

Column 17,
Line 5, "of, the" should read -- of: the --.
Line 7, "be, the" should read -- be: the --.

UNITED STATES PATENT AND TRADEMARK OFFICE

CERTIFICATE OF CORRECTION

PATENT NO. : 6,472,813 B2
DATED : October 29, 2002
INVENTOR(S) : Hideaki Mitsutake et al.

It is certified that error appears in the above-identified patent and that said Letters Patent is hereby corrected as shown below:

Column 18,
Line 49, “effect” should read -- effects --.

Column 19,
Line 9, “typically” should read -- typically, --.
Line 63, “across-sectional” should read -- a cross-sectional --.

Column 20,
Line 19, “reference” should read -- reference to --.
Line 66, “of that” should read -- as that --.

Column 22,
Line 59, “generators” should read -- generator --

Column 27,
Line 40, “structure.” should read -- structure.
As many apparently widely different embodiments of the present invention can be made without departing from the spirit and scope thereof, it is to be understood that the invention is not limited to the specific embodiments thereof except as defined in the appended claims. --

Column 30,
Line 30, “election-emitting” should read -- electron-emitting --.

Signed and Sealed this

Seventeenth Day of June, 2003

JAMES E. ROGAN
*Director of the United States Patent and Trademark Office*